US011186092B2

(12) United States Patent
Kobayashi et al.

(10) Patent No.: US 11,186,092 B2
(45) Date of Patent: Nov. 30, 2021

(54) PRINTING APPARATUS, PRINTING METHOD AND STORAGE MEDIUM

(71) Applicant: CANON KABUSHIKI KAISHA, Tokyo (JP)

(72) Inventors: Daisuke Kobayashi, Kawasaki (JP); Yushi Suematsu, Yokohama (JP); Kenichi Oonuki, Nishitokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/823,400

(22) Filed: Mar. 19, 2020

(65) Prior Publication Data

US 2020/0316948 A1 Oct. 8, 2020

(30) Foreign Application Priority Data

Apr. 5, 2019 (JP) ..... JP2019-072664

(51) Int. Cl.
*B41J 2/175* (2006.01)
*B41J 3/54* (2006.01)
*B41J 2/045* (2006.01)

(52) U.S. Cl.
CPC ..... *B41J 2/1752* (2013.01); *B41J 2/0458* (2013.01); *B41J 2/17553* (2013.01); *B41J 3/54* (2013.01)

(58) Field of Classification Search
CPC ..... B41J 2/1752; B41J 3/54; B41J 2/17553; B41J 2/0458; B41J 2/2052; B41J 2/04551; B41J 2/04528; B41J 2/04563; B41J 2/04598; B41J 2/195; B41J 2/1753; B41J 2/17509; B41J 29/02; B41J 29/13; B41J 11/42
USPC ..... 347/7
See application file for complete search history.

(56) References Cited

U.S. PATENT DOCUMENTS 6,086,180 A * 7/2000 Sugimoto ..... B41J 2/0454 347/14
6,213,579 B1 * 4/2001 Cornell ..... B41J 2/0454 347/14
8,783,832 B2 7/2014 Oonuki et al.
8,814,304 B2 * 8/2014 Miyahara ..... B41J 2/04551 347/14
8,888,223 B2 11/2014 Oonuki et al.
(Continued)

FOREIGN PATENT DOCUMENTS

JP H06-336024 A 12/1994
JP 2016-043635 A 4/2016

*Primary Examiner* — Huan H Tran
*Assistant Examiner* — Alexander D Shenderov
(74) *Attorney, Agent, or Firm* — Venable LLP

(57) ABSTRACT

One embodiment of the present invention is a printing apparatus including: a print head having a printing element column in which a plurality of printing elements for ejecting ink from ejection ports is arrayed and performing printing on a printing medium by ejecting ink based on print data; a sensor that detects temperature of the print head; an acquisition unit configured to acquire information indicating a number of dots to be printed by printing elements corresponding to a predetermined area in the printing element column; and a control unit configured to control a printing operation of the print head based on temperature detected by the sensor and the number of dots acquired by the acquisition unit, and the printing apparatus performs printing on the printing medium by ejecting ink from the print head while the print head and the printing medium are moving relatively.

23 Claims, 13 Drawing Sheets

(56) References Cited

U.S. PATENT DOCUMENTS

| | | | | |
|---|---|---|---|---|
| 9,033,471 | B2 | 5/2015 | Oonuki et al. | |
| 9,409,388 | B2 | 8/2016 | Edamura et al. | |
| 9,545,791 | B2 | 1/2017 | Oonuki et al. | |
| 2015/0022580 | A1* | 1/2015 | Goto | H04N 1/6036 347/19 |
| 2016/0052263 | A1* | 2/2016 | Edamura | B41J 29/02 347/14 |
| 2020/0108605 | A1* | 4/2020 | Osaki | B41J 2/18 |

* cited by examiner

PRINTING APPARATUS, PRINTING METHOD AND STORAGE MEDIUM

BACKGROUND OF THE INVENTION

Field of the Invention

The present disclosure relates to a printing apparatus, a printing method, and a storage medium.

Description of the Related Art

An ink jet printing apparatus is known, which prints an image by ejecting ink onto a printing medium by driving printing elements while causing a print head having a plurality of printing elements for ejecting ink to scan the printing medium. As one of the printing methods in the ink jet printing apparatus, there is a thermal method in which ink is ejected from the print head by making use of thermal energy generated from the heating element, such as a heater. Further, as one of the ink supply systems to the print head, there is a system of supplying ink to the print head via a supply tube (so-called tube supply system).

In the ink jet printing apparatus adopting the thermal method, in a case where an attempt is made to perform the ejection operation in a state where there is no ink within the print head (hereinafter, the ejection operation in a state where there is no ink is referred to as "vacant ejection"), the temperature of the print head rises abnormally. The reason is that the thermal energy generated by a heater is normally discharged by ink ejection, but in a case of vacant ejection, it is not possible to discharge heat by ink ejection. In a case where the temperature of the print head rises abnormally, there is a possibility that damage occurs, such as that a nozzle member forming the nozzle is peeled from the print head substrate.

In the ink jet printing apparatus adopting the tube supply system, even in a case where the ink tank becomes empty, the print head is not exchanged with another and a user continues to use the same print head. Because of this, it is necessary to protect the print head by preventing the abnormal temperature rise due to vacant ejection of the print head.

Japanese Patent Laid-Open No. H06-336024 has disclosed that the temperature detection unit is provided at both ends of the substrate of the print head and ejection of ink is stopped in a case where the temperature detected by the temperature detection element becomes higher than a predetermined temperature threshold value.

Further, Japanese Patent Laid-Open No. 2016-043635 has disclosed the method in which print data is checked before the printing operation and in a case where the number of dots to be printed is large, the printing speed is reduced, or divided printing is performed. According to Japanese Patent Laid-Open No. 2016-043635, in a case where the ink remaining amount is small, the printing element column within the print head is divided into printing element units including a plurality of printing elements and for each printing element unit, the print data of the next scan is acquired. Then, in a case where there is even one number of dots to be printed larger than or equal to a predetermined value, the number of divisions of the next scan is increased.

SUMMARY OF THE INVENTION

In a case where the temperature detection element is provided at both ends of the print head substrate as in Japanese Patent Laid-Open No. H06-336024, on a condition that vacant ejection is performed in a concentrated manner in the heater at the center of the substrate, which is located apart from the temperature detection element, there is a case where a deviation of temperature occurs between the temperature detection element and the vacant ejection portion due to a delay in heat conduction from the vacant ejection portion to the temperature detection element. In such a case, in order to prevent the abnormal temperature rise at the vacant ejection position, it is necessary to limit the printing operation by setting low a temperature threshold value used to determine the magnitude relationship of temperature between the vacant ejection position and the temperature detection element by taking into consideration the delay in heat conduction such as this. However, in a case where the temperature threshold value is set low, the printing operation is limited frequently even in the normal state where there is ink within the print head, and therefore, a reduction in throughput will result.

On the other hand, in the method of Japanese Patent Laid-Open No. 2016-043635, the number of divisions is increased in a case where there is even one printing element unit, which is obtained by dividing the printing element column, having the number of dots to be printed in the next scan larger than or equal to the predetermined value. As described in Japanese Patent Laid-Open No. H06-336024, in a case where even one temperature detection element is provided on the print head substrate, even though vacant ejection is performed, on a condition that the position at which vacant ejection is performed is in the vicinity of the temperature detection element, there is a possibility that it is possible for the temperature detection element to detect an abnormal temperature rise without the need to divide printing. However, Japanese Patent Laid-Open No. 2016-043635 does not refer to the relationship between the temperature detection element and the division condition. Because of this, division is performed also under the condition where it is originally possible to detect an abnormal temperature rise by the temperature detection element and it is not necessary to divide the print data, and therefore, throughput is reduced unnecessarily.

Further, as one element that governs the presence/absence of ink within the print head, there is gas penetration into the member of the ink supply path. Due to the gas penetration into the member in the ink supply path, the air in the atmosphere invades the ink supply path and by the ink including the air flowing to the ejection portion, there is a case where the ink at the ejection portion runs short. This occurs irrespective of the ink remaining amount in the ink tank and occurs more frequently in the tube supply system whose ink supply path is long. In Japanese Patent Laid-Open No. 2016-043635, the division control of printing is performed only in the state where the ink remaining amount is small, and therefore, this is insufficient to prevent an abnormal temperature rise resulting from the gas penetration into the ink supply path.

Consequently, in view of the above-described problem, an object of one embodiment of the present invention is to prevent trouble from occurring due to an abnormal temperature rise of the print head at the time of the ejection operation while suppressing a reduction in throughput irrespective of the ink remaining amount in the ink tank.

Means for Solving Problem

One embodiment of the present invention is a printing apparatus including: a print head having a printing element column in which a plurality of printing elements for ejecting ink from ejection ports is arrayed and performing printing on a printing medium by ejecting ink based on print data; a sensor that detects temperature of the print head; an acquisition unit configured to acquire information indicating a number of dots to be printed by printing elements corresponding to a predetermined area in the printing element column; and a control unit configured to control a printing operation of the print head based on temperature detected by the sensor and the number of dots acquired by the acquisition unit, and the printing apparatus performs printing on the printing medium by ejecting ink from the print head while the print head and the printing medium are moving relatively, the acquisition unit acquires information indicating a number of dots to be printed by the printing elements not including printing elements in the vicinity of the sensor in the printing element column and within a predetermined area apart from the printing elements in the vicinity of the sensor in an array direction of the printing elements, and the control unit controls, in a case where the number of dots indicated by the information, which corresponds to the predetermined area, is smaller than or equal to a threshold value, the printing operation of the print head so as to perform the printing operation in a first mode, and controls, in a case where the number of dots is larger than the threshold value, the printing operation of the print head so as to perform the printing operation in a second mode in which a number of dots to be printed per unit time by ejecting ink from the print head is smaller than that in the first mode.

Further features of the present invention will become apparent from the following description of exemplary embodiments with reference to the attached drawings.

DESCRIPTION OF THE EMBODIMENTS

First Embodiment

<About Structure of Printing Apparatus>

Figure 1:
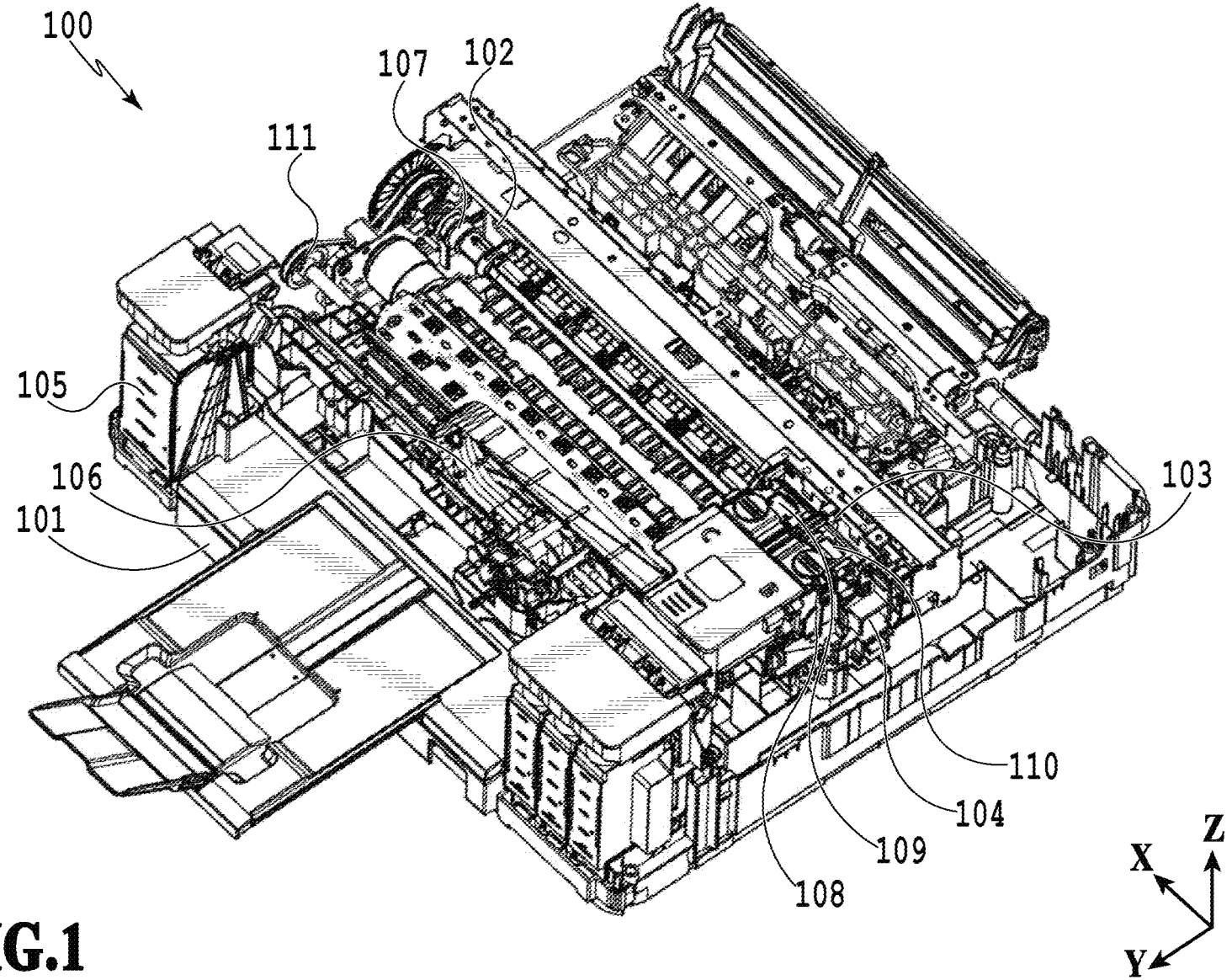
FIG. 1 is a perspective diagram showing an internal structure of a printing apparatus.

In the following, the structure of a printing apparatus of the present embodiment is explained by using FIG. 1. FIG. 1 is a perspective diagram partially showing the internal structure of a printing apparatus 100 of the present embodiment. As shown in FIG. 1, the printing apparatus 100 has a sheet feed unit 101, a conveyance unit 102, a printing unit 103, a recovery unit 104, an ink tank 105, and an ink supply tube 106. Printing media loaded on the sheet feed unit 101 are picked up one by one and sent out and fed to the conveyance unit 102 by a pickup roller and a sheet feed roller, not shown schematically, which are driven by a sheet feed motor, not shown schematically. The conveyance unit 102 conveys a printing medium supplied by the sheet feed unit 101. The printing medium fed to the conveyance unit 102 is pinched and conveyed so as to pass the printing unit 103 by a conveyance roller 107 that is driven by a conveyance motor, not shown schematically, and a pinch roller, not shown schematically. The printing unit 103 prints an image by ejecting ink onto the printing medium from a print head, to be described later, based on print data created from image data. The print head is supplied with ink from the ink tank 105 via the ink supply tube 106. The printing unit 103 comprises a carriage 108 capable of reciprocating in a direction (X-direction in FIG. 1) intersecting with a direction (Y-direction in FIG. 1) in which the printing medium is conveyed, a print head 109, and a print head 110, to be described later, which are mounted on the carriage 108. The Y-direction in which the print medium is conveyed is referred to as "conveyance direction" and the X-direction intersecting with the conveyance direction is referred to as "scanning direction". Further, a Z-direction intersecting with both the X-direction and the Y-direction is referred to as "gravitational direction."

The carriage 108 is supported so as to be capable of reciprocating in the X-direction along a guide rail installed in the printing apparatus 100. The carriage 108 reciprocates in a printing area at the time of performing printing on a printing medium via a carriage belt, not shown schematically, which is driven by a carriage motor, not shown schematically. By an encoder sensor, not shown schematically, which is mounted on the carriage 108, and an encoder scale, not shown schematically, which is tensioned in the printing apparatus 100, the position and the speed of the carriage 108 are detected and the movement of the carriage 108 is controlled based on the position and the speed. While the carriage 108 is moving, by the print head 109 and the print head 110 ejecting ink, an image is printed on a printing medium. The printing medium is pinched by a sheet discharge roller 111 that is driven in synchronization with the conveyance roller 107 and a spur, not shown schematically, which is pressed by the sheet discharge roller 111 and discharged to the outside of the printing apparatus 100 by the conveyance unit 102. The recovery unit 104 has a wiping mechanism that recovers the state of the nozzle surface to the normal state by wiping off ink droplets having stuck to the surface (so-called nozzle surface) of the print head 109 and the print head 110, on which nozzles are provided. Further, the recovery unit 104 has a capping mechanism for covering the nozzles and a suction mechanism for sucking in ink from the nozzles via the capping mechanism.

<About Structure of Print Head>

Figure 2A:
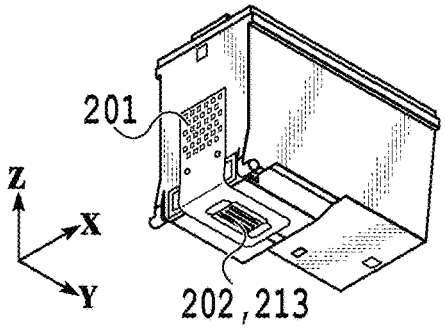
FIG. 2A to FIG. 2E are schematic diagrams showing a structure of a print head.
Figure 2B:
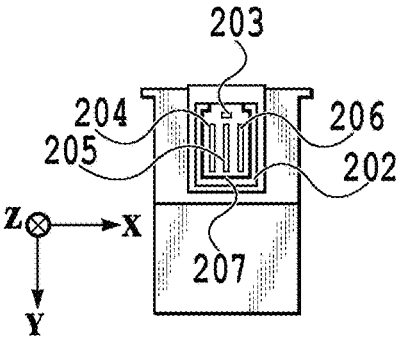
Figure 2C:
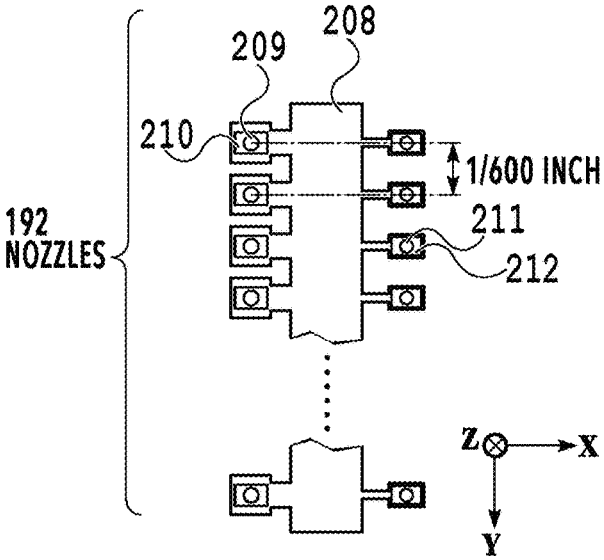
Figure 2D:
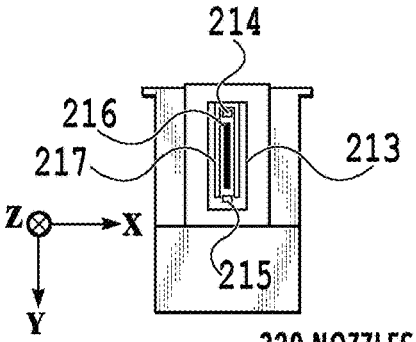
Figure 2E:
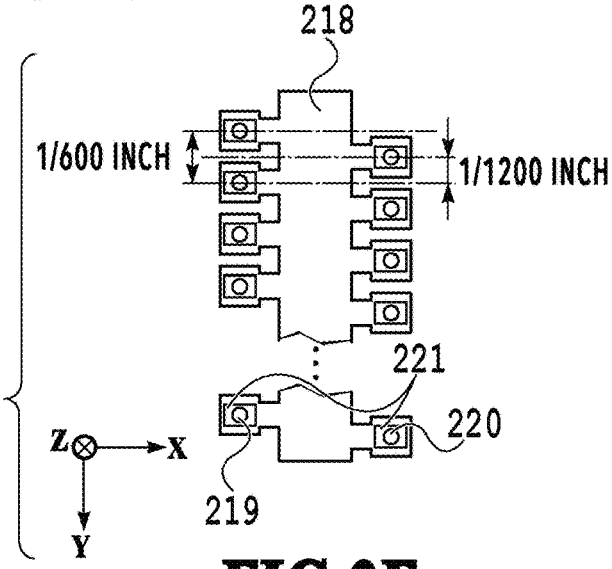

In the following, the structure of the print head is explained by using FIG. 2A to FIG. 2E. As described previously, in the printing apparatus 100, two print heads (specifically, the print heads 109 and 110) are mounted on the carriage 108. FIG. 2A to FIG. 2E are schematic diagrams showing the structure of the print heads 109 and 110 according to the present embodiment. FIG. 2A is a perspective diagram of a part of the print head 109 or the print head 110. FIG. 2B is a bottom diagram in a case where the print head 109 is viewed from below in the gravitational direction and FIG. 2C is an enlarged diagram of a nozzle column 204 of cyan ink of the print head 109. FIG. 2D is a bottom diagram in a case where the print head 110 is viewed from below in the gravitational direction and FIG. 2E is an enlarged diagram of a nozzle column 216 of black ink of the print head 110. In the present specification, for simplicity, cyan is indicated by C, magenta by M, yellow by Y, and black by Bk.

The print heads 109 and 110 receive a print signal from the printing apparatus main body via a contact pad 201. Further, the print heads 109 and 110 are supplied with power necessary to drive the print head via the contact pad 201.

As shown in FIG. 2B, on a print head substrate 202 of the print head 109, a diode sensor 203 that detects the temperature of the print head substrate, the nozzle column 204 that eject C ink, a nozzle column 205 that ejects M ink, and a nozzle column 206 that ejects Y ink are arranged. Further, on the print head substrate 202, a sub heater 207 for heating ink, which is arranged so as to surround largely the nozzle columns 204 to 206, is provided. Hereinafter, the diode is abbreviated to Di and for example, the diode sensor is described as Di sensor. The sensor that detects temperature is not limited to the Di sensor and it may also be possible to adopt any sensor other than the Di sensor.

As shown in FIG. 2C, on both sides of an ink chamber 208, a nozzle that ejects ink of 5 μl and a nozzle 211 that ejects ink of 2 μl are arranged. Immediately under each nozzle 209 (on the side in the +Z-direction), a 5-μl ejection heater 210 is arranged and immediately under each nozzle 211 (on the side in the +Z-direction), a 2-μl ejection heater 212 is arranged. In the present embodiment, as the printing element for ejecting ink, the ejection heater is used. The total number of nozzles 209 and the total number of nozzles 211 are the same and 192 and the interval between nozzles is 1/600 inches.

As shown in FIG. 2D, on a print head substrate 213 of the print head 110, Di sensors 214 and 215 are arranged at both ends in the Y-direction thereof and the nozzle column 216 that ejects Bk ink is arranged. Further, a sub heater 217 for heating ink is provided, which is arranged so as to surround largely the nozzle column 216.

As shown in FIG. 2E, on both sides of an ink chamber 218, nozzles 219 and 220 that eject ink of 12 μl are arranged. Immediately under each nozzle (on the side in the +Z-direction), a 12-μl ejection heater 221 is arranged. The total number of nozzles 219 arranged on the left side in FIG. 2E and the total number of nozzles 220 arranged on the right side in FIG. 2E are the same and 320 and the interval between nozzles adjacent in the Y-direction is 1/600 inches. The nozzle column including the nozzle 219 and the nozzle column including the nozzle 220 are shifted by 1/1,200 inches in the Y-direction. By applying a driving pulse whose magnitude is such that ink is not ejected to the ejection heaters 210, 212, and 221, it is possible to retain the temperature of the ink. The temperature-retention control such as this is called "short-pulse heating control". The printing apparatus according to the present embodiment adjusts the temperature of the print head substrate and the ink temperature (hereinafter, called together head temperature) by performing the short-pulse heading control and control of the sub heater.

<About Configuration of Control System>

Figure 3:
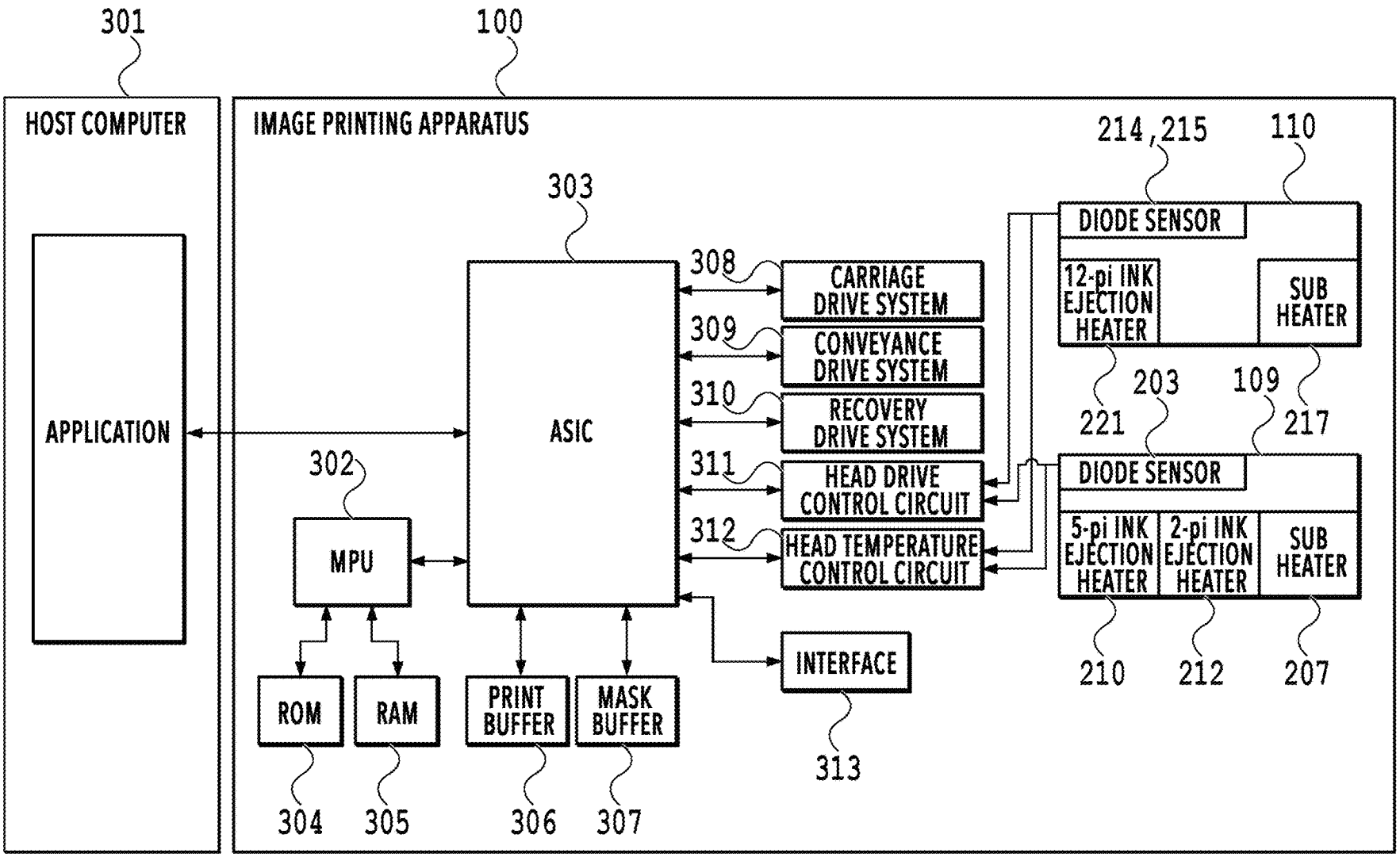
FIG. 3 is a block diagram showing a configuration of a control system of the printing apparatus.

In the following, the configuration of the control system of the printing apparatus 100 is explained by using FIG. 3. FIG. 3 is a block diagram showing the configuration of the printing control system in the printing apparatus 100. A host computer 301, which is an image input unit, transmits multivalued image data in the bitmap format to the printing apparatus 100, in which each pixel has a value (for example, 0 to 255) of each of three channels R, G, and B and which is stored in various storage media, such as a hard disk and a memory. The image data transmitted to the printing apparatus 100 is transferred to an image processing unit including an MPU 302, an ASIC 303, and the like, to be described later. It may also be possible for the host computer 301 to transmit the multivalued image data to the printing apparatus 100, which is received from an external image input device, such as a scanner and a digital camera, which is connected to the host computer 301.

The image processing unit creates data (hereinafter, also referred to as print data) in the binary bitmap format in which each pixel has a value of 0 or a value of 1 as data for ejecting ink from the print heads 109 and 110 by performing binarization processing and mask processing for the input multivalued image data. The printing apparatus 100, which is an image output unit, prints an image by attaching ink to a printing medium based on the print data created by the image processing unit. The printing apparatus 100 is controlled by the MPU (Micro Processor Unit) 302 in accordance with programs stored in a ROM 304. A RAM 305 functions as a work area and a temporary data saving area of the MPU 302. The MPU 302 controls, via the ASIC 303, a carriage drive system 308 for driving the carriage 108, a conveyance drive system 309 for conveying a printing medium, and a recovery drive system 310 for recovering the print heads 109 and 110. Further, the MPU 302 controls, via the ASIC 303, a head drive control circuit 311 for driving the print heads 109 and 110, a head temperature control circuit 312 for controlling the temperature of the print heads 109 and 110, and an interface 313.

The recovery drive system 310 is a system that performs suction of ink from the nozzle of the print head, wiping of the nozzle surface, pre-ejection, and the like. In a print buffer 306, print data converted into the format that can be transferred to the print heads 109 and 110 is stored temporarily. In a mask buffer 307, a plurality of mask patterns is stored temporarily, which is applied at the time of transferring print data to the print heads 109 and 110. The plurality of mask patterns is used at the time of performing a printing mode in which printing is performed by a method of performing ejection accompanied by a plurality of times of scan of the print head on the unit area on a printing medium, that is, a printing mode in which printing is performed by a so-called multi-pass printing method. The plurality of mask patterns is stored in advance in the ROM 304 and the relevant mask pattern is read from the ROM 304 and stored in the mask buffer 307 at the time of actual printing.

Here, the aspect is described in which the image processing unit exists in the printing apparatus 100, but the image processing unit may exist in the host computer 301. Further, it is assumed that the printing apparatus 100 is compatible with a printing medium of up to A4 size (8.27 in.×11.69 in.) and the printing resolution in the carriage advance direction is 600 dpi. Here, the printing ratio in a case where two dots are arranged in the grid of 600 dpi×600 dpi is defined as 100% duty. In a case of the print head 110, the nozzle resolution in the y-direction is 1,200 dpi, and therefore, in a case where one dot is arranged in each grid of 600 dpi×600 dpi from one nozzle, the printing ratio is 100% duty.

The head temperature control circuit 312 determines the drive condition of the sub heaters 207 and 217 on the print heads 109 and 110 based on the output values of the Di sensors 203, 214, and 215 that detect the print head temperature. Then, the head drive control circuit 311 drives the sub heaters 207 and 217 based on the determined drive condition. The head drive control circuit 311 further drives the ejection heaters 210, 212, and 221 on the print heads 109 and 110. By driving these heaters, the head drive control circuit 311 causes the print heads 109 and 110 to perform pre-ejection, ink ejection, and head temperature adjustment for temperature adjustment control. The program for performing temperature adjustment control is stored, for example, in the ROM 304 and causes detection of the head temperature, drive of the sub heaters 207 and 217, and the like to be performed via the head temperature control circuit 312, the head drive control circuit 311, and the like. It is also possible for the head drive control circuit 311 to perform PWM control by driving the ejection heaters 210, 212, and 221 by the drive signal including a pre-pulse and a main pulse.

<About Acquisition of Head Temperature>

Figure 4:
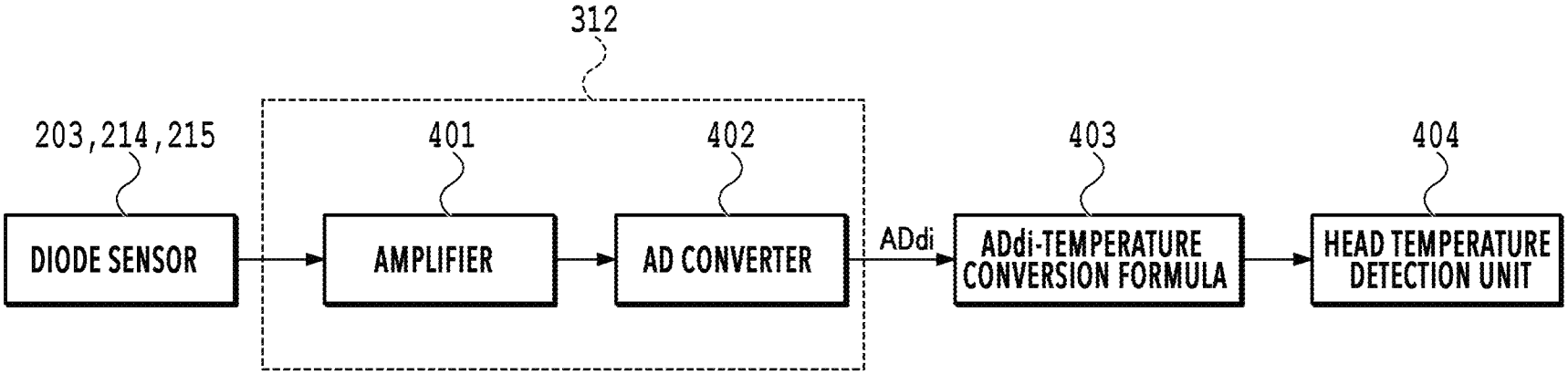
FIG. 4 is a block diagram showing a flow of print head temperature acquisition processing.

In the following, processing to perform control so as to acquire head temperature (referred to as "head temperature acquisition processing") is explained by using FIG. 4. FIG. 4 is a block diagram showing a flow of head temperature acquisition processing including processing within the head temperature control circuit 312 and processing performed on software by using the ROM 304 and the RAM 305. In a case where a voltage based on the head temperature from the Di sensor 203 possessed by the print head 109 and a voltage based on the print head from the Di sensors 214 and 215 possessed by the print head 110 are input to the head temperature control circuit 312, the voltage value is amplified by an amplifier 401. The voltage value amplified by the amplifier 401 is digitalized by an AD converter 402. A digitalized Di sensor voltage value ADdi is converted into Di temperature Th by an ADdi-temperature conversion formula 403 stored in advance in the ROM 304. The Di temperature Th obtained as described above is input to a head temperature detection unit 404. The above is the contents of acquisition of head temperature.

In the present embodiment, the temperature that causes trouble to occur in the print head whose temperature has risen abnormally is defined as an upper limit temperature Tf. In order to prevent the trouble due to the abnormal temperature rise of the print head, it is necessary to suppress the temperature at the vacant ejection portion to Tf or less even in a case where the print head performs vacant ejection. On the other hand, it is difficult to prevent air bubbles from invading the ink supply path, which results from gas penetration of the members of the ink supply tube 106 and the print heads 109 and 110, and therefore, it is necessary to prepare for the abnormal temperature rise due to vacant ejection at all times. In the present embodiment, by taking the print head 110 as an example, a printing method is explained by using FIG. 5 to FIG. 9D, which is capable of preventing the abnormal temperature rise due to vacant ejection while suppressing an unnecessary reduction in throughput even in a state where there is ink within the print head 110.

<About Printing Processing>

Figure 5:
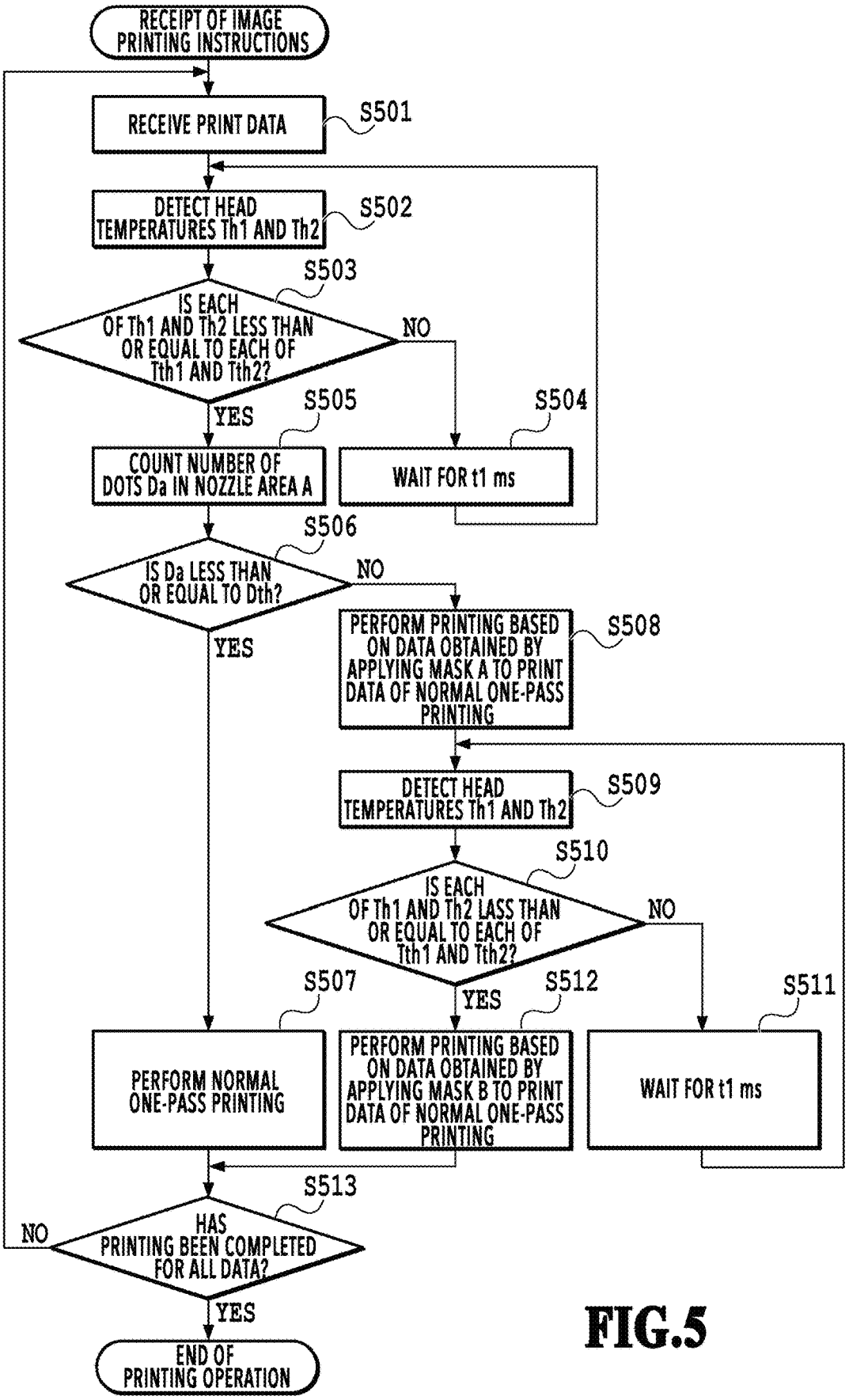
FIG. 5 is a flowchart of printing processing according to a first embodiment.

In the following, processing for performing the printing operation in the print head 110 according to the present embodiment is explained by using FIG. 5. In the present embodiment, based on the combination of information relating to the type of the printing medium and printing quality, the number of times (hereinafter, also referred to as number of passes) the print head is caused to scan the unit area on the printing medium is determined. In a case where the number of times is determined to be a predetermined number of times, printing is performed by causing the print head to scan the determined number of times and at this time, the printing medium is not conveyed and printing is performed by causing the print head to scan the predetermined number of times. FIG. 5 is a flowchart of printing processing in a case where instructions to print a one-pass monochrome image are received.

In a case where the printing apparatus 100 receives the image printing instructions, a series of processing starts. First, at step S501, the MPU 302 receives print data corresponding to a one-time scan. Hereinafter, "step S-" is abbreviated simply to "S-".

At S502, the MPU 302 detects the temperature of the print head 110. Specifically, the MPU 302 detects temperature (referred to as Th1) at one end in the Y-direction by using the diode sensor 214 and detects temperature (referred to as Th2) at the other end in the Y-direction by using the diode sensor 215.

At S503, the MPU 302 determines the magnitude relationship between the temperatures detected at S502 and a predetermined temperature threshold value. Specifically, whether the detected temperature Th1 is less than or equal to a predetermined temperature threshold value (referred to as Tth1) and the detected temperature Th2 is less than or equal to a predetermined temperature threshold value (referred to as Tth2) is determined. In a case where determination results at this step are affirmative, the processing advances to S505. On the other hand, in a case where the determination results at this step are negative, that is, at least one of Th1 and Th2 exceeds the predetermined temperature threshold value, the processing advances to S504 because performing vacant ejection in the next scan will cause the temperature of the print head 110 to reach Tf and there is a possibility that trouble will occur.

At S504, the MPU 302 stands by for a predetermined time (referred to as t1 [ms]). In the present embodiment, it is assumed that t1=30 [ms], but any value may be used as t1.

At S505, among dots that are printed by the scan, a number of dots Da printed by nozzles in a predetermined area (referred to as nozzle area A) within the nozzle column 216 of the print head 110 is counted. The nozzle area A is an area not including the nozzles in the vicinity of the Di sensor and apart from the nozzles in the vicinity of the Di sensor in the nozzle column direction. In the present embodiment, the Di sensor is provided at both ends in the nozzle column direction, and therefore, the center portion in the nozzle column direction is the nozzle area A. The nozzles in the vicinity of the Di sensor refer to the nozzles including the nozzle the nearest to the Di sensor in the nozzle array direction and within a predetermined distance in the nozzle column direction from the nearest nozzle. Here, the predetermined distance is the distance corresponding to 160 nozzles, but it is possible to appropriately set the predetermined distance by taking into consideration the nozzle array pitch and the way heat is conducted depending on the quality of material of the substrate. The number of dots Da is counted by the MPU 302 or the ASIC 303 within the image processing unit in the time during which the print data of the scan is stored in the print buffer 306.

At S506, the MPU 302 determines the magnitude relationship between the number of dots Da counted at S505 and a predetermined number of dots threshold value (referred to as Dth). Specifically, whether or not the number of dots Da is less than or equal to the number of dots threshold value Dth. The data of the number of dots threshold value Dth is stored in the ROM 304 or the RAM 305. In a case where determination results at this step are affirmative, the processing advances to S507. On the other hand, in a case where the determination results at this step are negative, the processing advances to S508 in order to perform printing by dividing the next scan into two passes. Details of the setting method of the nozzle area A and the number of dots threshold value Dth will be described later.

At S507, the MPU 302 performs the normal one-pass printing as the next scan.

At S508, the MPU 302 performs printing based on the data obtained by applying a mask A to the print data at the time of the one-pass printing. The time taken for printing of one scan is the same in a case of one-pass printing at S507 and in a case where the data is divided and two-pass printing is performed at S508 because the scanning speed of the carriage 108 does not change and remains a predetermined speed. In a case where printing is performed based on the data to which the mask A is applied, the number of dots to be printed by ejecting ink in one scan is smaller than that in the one-pass printing at S507.

After S508, at S509 to S511, after the head temperature is checked, at S512, printing based on data obtained by applying a mask B to the print data at the time of one-pass printing is performed as in the case with S502 to S504. The mask A and the mask B are in a complementary relationship and by the printing at S508 and S512, the same printing as that at the time of the normal one-pass printing is performed. Details of the setting method of the mask A and the mask B will be described later.

At S513, the MPU 302 determines whether the printing of all the data received at S501 is completed. In a case where determination results at this step are affirmative, the series of processing terminates. On the other hand, in a case where the determination results at this step are negative, the processing returns to S501.

By the above processing, in a case where the number of dots Da exceeds the number of dots threshold value Dth, it is possible to prevent the temperature of the print head from rising too much due to vacant ejection by reducing the number of dots to be printed per unit time. In the example described above, it is possible to reduce the number of dots to be printed within one scan.

<About Setting Method of Temperature Threshold Values Tth1 and Tth2>

In the following, the setting method of the temperature threshold values Tth1 and Tth2 that are used at S503 described previously is explained by using FIG. 6A to FIG. 6D. It is possible to set the nozzle area A that is used at S505 and the number of dots threshold value Dth that is used at S506 based on the temperature rise characteristic, the temperature threshold values Tth1 and Tth2, and the upper limit temperature Tf at the time of vacant ejection of the print head 110.

The printing condition under which the temperature at the vacant ejection portion of the print head is likely to rise is a case where vacant ejection is performed in a concentrated manner with high duty at the position that requires time for heat conduction from the vacant ejection portion to the temperature detection element of the print head, such as the Di sensor, that is, the position apart from the Di sensor. In an aspect in which the Di sensor is located at both ends of the print head substrate as in the print head 110, in a case where vacant ejection is performed with 100% duty at the center of the print head substrate, the temperature is most likely to rise.

Here, as an example, a case is explained where the relationship between temperature rise characteristic of the Di sensor and the temperature rise characteristic at the center of the print head substrate becomes a relationship shown in FIG. 6A to FIG. 6D on a condition that vacant ejection is performed with 100% duty at the center of the print head 110. Here, it is assumed that the upper limit temperature Tf is 200° C.

Figure 6A:
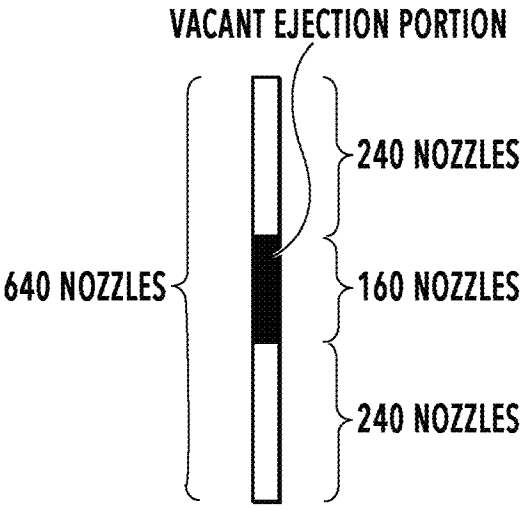
FIG. 6A to FIG. 6D are diagrams showing the temperature rise characteristic at the time of vacant ejection of the print head according to the first embodiment.

First, a case where 160 nozzles, which are shown in black in FIG. 6A, at the center among 640 nozzles of the print head substrate, specifically, a case where vacant ejection of only the 160 nozzles is continued with 100% duty while causing the print head to scan across the width of an A4 sheet is explained. In this case, the temperature of the Di sensor 214 and the temperature at the center of the print head substrate change as shown in FIG. 6B. The temperature of the Di sensor 215 also changes like the temperature of the Di sensor 214. The time from one scan to the next one scan is the time during which the printing medium is conveyed, printing stands by due to the temperature rise of the print head, and so on.

Figure 6C:
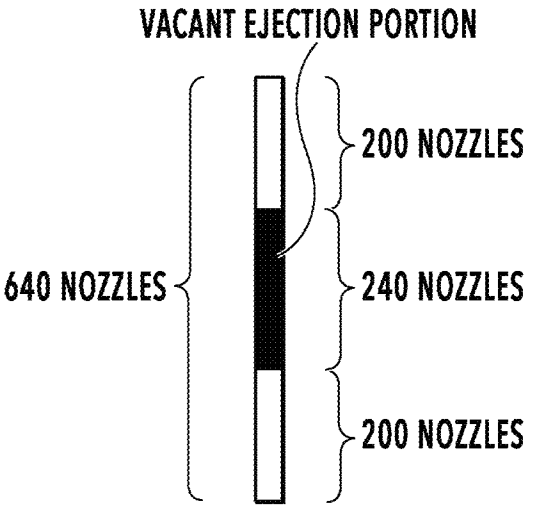
Figure 6B:
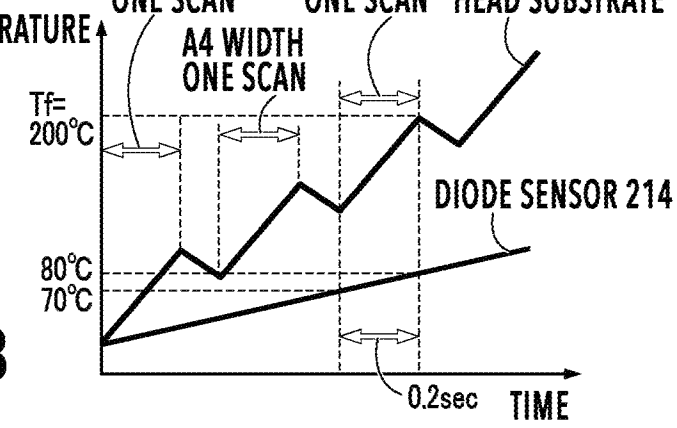
Figure 6D:
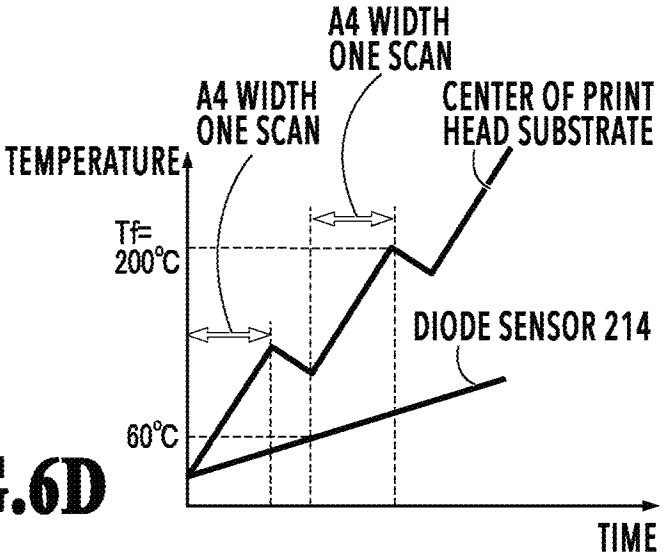

Following the above, a case where 240 nozzles, which are shown in black in FIG. 6C, at the center among 640 nozzles of the print head substrate, more specifically, a case where the scan is continued in which vacant ejection of only the 240 nozzles is performed with 100% duty across the width of an A4 sheet is explained. In this case, the temperature of the Di sensor 214 and the temperature at the center of the print head substrate change as shown in FIG. 6D. The temperature of the Di sensor 215 also changes like the temperature of the Di sensor 214.

In the case of FIG. 6C and FIG. 6D, by the vacant ejection of one scan immediately after the timing at which the temperature of the diode sensor before the scan reaches 60° C., the temperature at the center of the print head substrate reaches Tf (=200° C.). Consequently, in order to prevent a failure of the print head, it is necessary to set the temperature threshold values Tth1 and Tth2 to 60° C. or less. On the other hand, in the case of FIG. 6A and FIG. 6B, by the vacant ejection of one scan immediately after the timing at which the temperature of the diode sensor before the scan reaches 70° C., the temperature at the center of the print head substrate reaches Tf. Consequently, in order to prevent a failure of the print head, it is necessary to set the temperature threshold values Tth1 and Tth2 to 70° C. or less.

As described above, in a case where vacant ejection is performed in the nozzle a predetermined distance or more apart from the Di sensor, generally, in many cases, the larger the number of nozzles in which vacant ejection is performed, the more the heat generation amount is. Further, at the timing at which the temperature at the vacant ejection portion is the same, in many cases, the larger the number of nozzles in which vacant ejection is performed, the lower the detected temperature of the Di sensor is. In order to prevent a failure of the print head, which is caused by vacant ejection, only by the temperature detection of the Di sensor as in the prior art, it is necessary to set the temperature threshold values Tth1 and Tth2 based on the condition under which the deviation between the temperature at the vacant ejection portion and the detected temperature of the Di sensor becomes the largest. By setting the temperature threshold values Tth1 and Tth2 as described above, the temperature threshold values Tth1 and Tth2 becomes lower inevitably as described previously, and therefore, the operation is limited frequently even in the state where there is ink. Further, in a case of the data with which the inside of the nozzle column is printed uniformly or the data with which the vicinity of the Di sensor is printed, even on a condition that vacant ejection is performed, the change in temperature of the nozzle is likely to be conveyed to the Di sensor, and therefore, the temperature is unlikely to become a temperature considerably exceeding the upper limit temperature. On the other hand, in printing of the data with which the inside of the nozzle column is printed uniformly, in many cases, the detected temperature value of the Di sensor is higher than the local print data as in FIG. 6A and FIG. 6C. Because of this, the temperature is likely to exceed the temperature threshold value and an unnecessary reduction in throughput will result. Consequently, detecting only the pattern whose print head center is high duty, which has a risk that the temperature exceeds the upper limit temperature considerably at the time of vacant ejection, dividing only the scan, and increasing the temperature threshold values Tth1 and Tth2 will be more effective to suppress a reduction in throughput.

In the present embodiment, on the assumption that it is possible to sufficiently suppress a reduction in throughput in a case where Tth1 and Tth2 are 70° C., a setting example of parameters at that time is described in the following. It is assumed that the printing medium here has the A4 size (8.27 in.×11.69 in.). In a case of FIG. 6A and FIG. 6B, that is, in a case where Tth1=Tth2=70° C., by controlling the number of dots of the next scan to 160×8.27 in.×600 dpi×100% duty=793,920 dots or less, it is possible to control the temperature at the vacant ejection portion to Tf or less. Consequently, by setting the number of dots threshold value Dth to 793,920 [dot], it is possible to prevent trouble of the print head due to the abnormal temperature rise. In a case where the size of the printing medium is different, it may also be possible to set the number of dots threshold value Dth to a different value.

Figure 7:
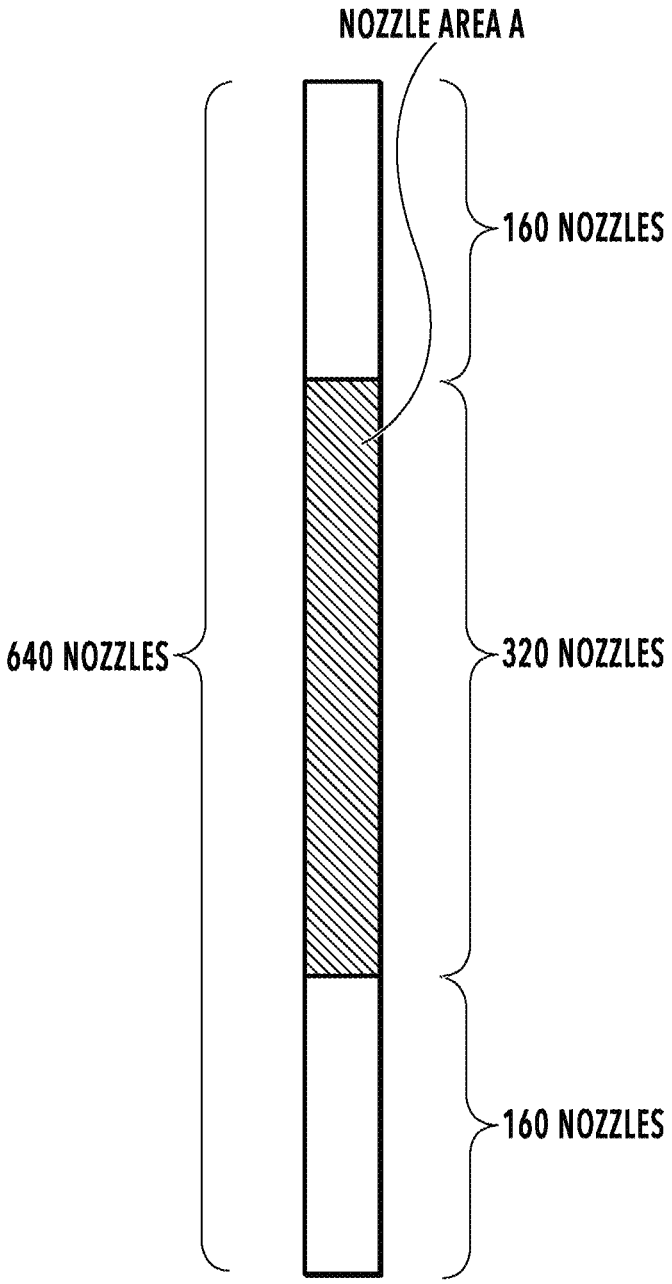
FIG. 7 is a diagram showing a nozzle area A according to the first embodiment.

On the other hand, in a case where duty at the vacant ejection portion is low, the deviation between the temperature at the vacant ejection portion and the detected temperature of the Di sensor is small, and therefore, even thought the nozzle at the vacant ejection portion is located at any position, the temperature at the vacant ejection portion does not reach Tf. Here, as an example, it is assumed that in a case where duty at the vacant ejection portion is 50% or less, under the condition that Tth1=Tth2=70° C., Tf is not reached irrespective of the number of nozzles. In this case, on a condition that the relationship between the nozzle area A and Dth satisfies a relationship of Dth≤(number of nozzles in nozzle area A×A4 width×printing resolution×50% duty), the temperature at the vacant ejection portion no longer reaches Tf even in a case where printing is performed based on any print data within the predetermined area. Specifically, it is recommended to set the area including 320 nozzles at the center of the print head substrate as shown in FIG. 7 as the nozzle area A that satisfies the condition described previously.

Figure 9A:
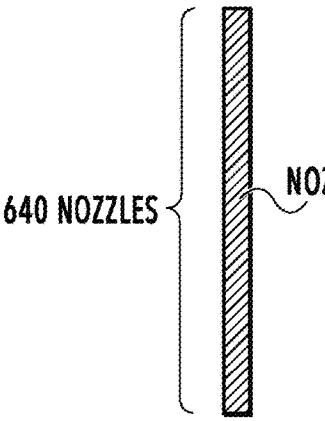
FIG. 9A to FIG. 9D are diagrams showing a prior art.

Here, as a comparison with the present embodiment, by using FIG. 9A to FIG. 9D, an example is shown in which the nozzle area in which the number of dots is counted is set irrespective of the position of the Di sensor, which is performed conventionally. FIG. 9A shows a case where the area of a total of 640 nozzles including in the nozzle column is set as the nozzle area A in which the number of dots is counted. It is assumed that the condition of the number of dots threshold value Dth for preventing a failure of the print head in this case is 160×8.27 in.×600 dpi×100% duty=793,920 dots, which is the same as that described previously. Consequently, the condition that the printing operation is divided is a case where 100% duty×160 nozzles/640 nozzles=25% duty is exceeded. As a result of that, also at the time of performing printing based on the data printed with duty corresponding to 26% duty by using all the nozzles as shown in 9C, the printing operation is divided. As described previously, in a case where Tf is not reached even though vacant ejection is performed on a condition that duty at the ejection portion is 50% or less, it is not necessary to divide the printing operation with 26 to 50% duty. Consequently, the division such as this will lead to an unnecessary reduction in throughput.

Figure 9B:
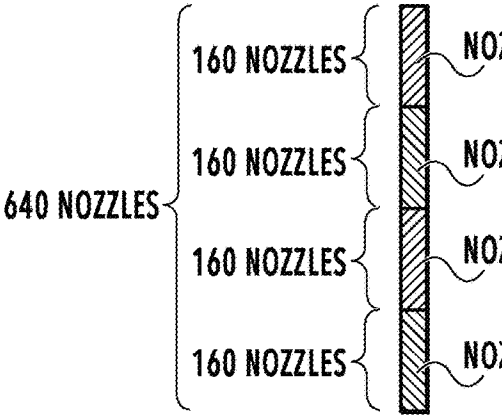
Figure 9C:
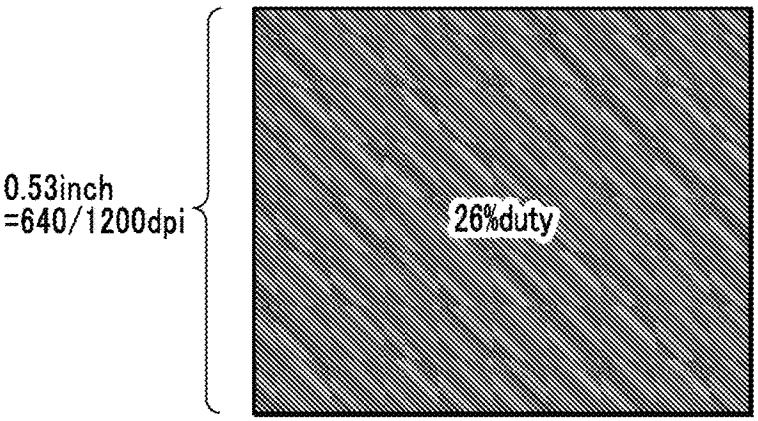
Figure 9D:
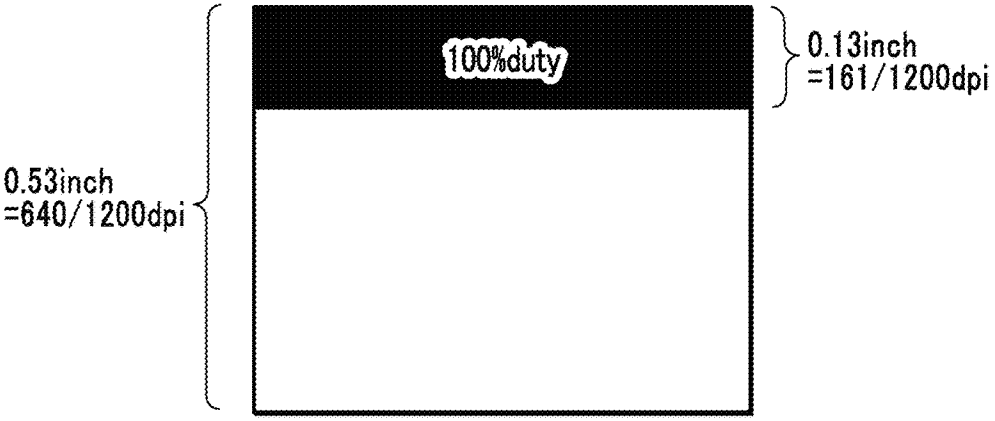

Similarly, also in a case where printing is performed based on the print data with 100% duty using 161 nozzles as in FIG. 9D, the printing operation is divided as a result. However, in a case where vacant ejection is performed in the nozzle in the vicinity of the Di sensor, even on a condition that duty is high, the detected temperature of the Di sensor reaches the temperature threshold value Tth before the temperature at the vacant ejection portion reaches Th, and therefore, it is not necessary to divide the printing operation. Consequently, the division such as this will lead to an unnecessary reduction in throughput.

Compared to FIG. 9A, FIG. 9B shows a case where the nozzle column is divided into small areas (in this example, the area of 640 nozzles is divided into four areas). In this case, in order to control the number of nozzles at the time of vacant ejection of the print head substrate to 160 or less, it is necessary to set the number of dots threshold value Dth so as to control the number of vacant ejection-target nozzles to 80 or less in areas B and C. At this time, in a case where the same value as the number of dots threshold value Dth set to areas B and C is set to areas A and D as in the prior art, as in the case with FIG. 9A, the printing operation based on the print data in FIG. 9D is divided as a result, and therefore, an unnecessary reduction in throughput will result. The above is the method performed conventionally.

Compared to the prior art described previously, in the present embodiment, the area in which the vacant ejection-target nozzles are counted is limited as shown in FIG. 7. By doing so, the printing operation based on the print data as shown in FIG. 9C or FIG. 9D is no longer divided. In the present embodiment, the area in which the vacant ejection-target dots are counted at the time of dividing the printing operation is set to the area a predetermined distance apart from the temperature detection element, such as the Di sensor. That is, the area in which dots are counted is set so that the nozzle whose distance to the Di sensor is within a predetermined value is not included in the area. Due to this, it is made possible to prevent trouble of the print head at the time of vacant ejection while suppressing an unnecessary reduction in throughput. Further, in the present embodiment, the control is performed only by the detected temperature by the Di sensor and the division/non-division of the printing operation, and therefore, it is possible to perform control that does not depend on the ink remaining amount within the print head. That is, even in a case where there is no ink within the print head due to gas penetration of the ink supply member, it is made possible to prevent trouble of the print head due to vacant ejection.

<About Application of Mask>

In the following, a mask application method, that is, the specific control method at S508 and S512 and its effects according to the present embodiment are explained. As in the case with S508 and S512, in a case of two-pass printing with the mask A and the mask B, it is desirable to be able to obtain the density equivalent to that at the time of normal one-pass printing in a case where ink is ejected in the state where there is ink within the print head, and suppress the temperature rise of the print head at the time of vacant ejection. Specifically, it is made possible to obtain the density equivalent to that at the time of normal one-pass printing by suppressing a reduction in ink coverage on a printing medium resulting from the deviated landing position in the X-direction between the first pass and the second pass. Further, in a case where there is an area in which the thermal conductivity is relatively low within the print head substrate, such as the ink chamber 218, the print data is distributed equally to a nozzle column (hereinafter, Odd column) including the nozzle 219 and a nozzle column (hereinafter, Even column) including the nozzle 220. On the assumption that the time required for one scan is the unit time, in a case where two-pass printing is performed with the mask A and the mask B, the amount of ink that is ejected per unit time is about half that in a case where one-pass printing is performed. Further, for example, also on the assumption that the time required for printing of the area width half the area width corresponding to one scan in one-pass printing is the unit time, the amount of ink that is ejected per unit time in a case where two-pass printing is performed is about half compared to that in a case where one-pass printing is performed. Due to this, it is possible to reduce the frequency of ejection from the ejection port, that is, it is possible to reduce the driving frequency of the printing element, and therefore, it is made possible to suppress the temperature rise within the nozzle column at the time of vacant ejection.

Figure 8B:
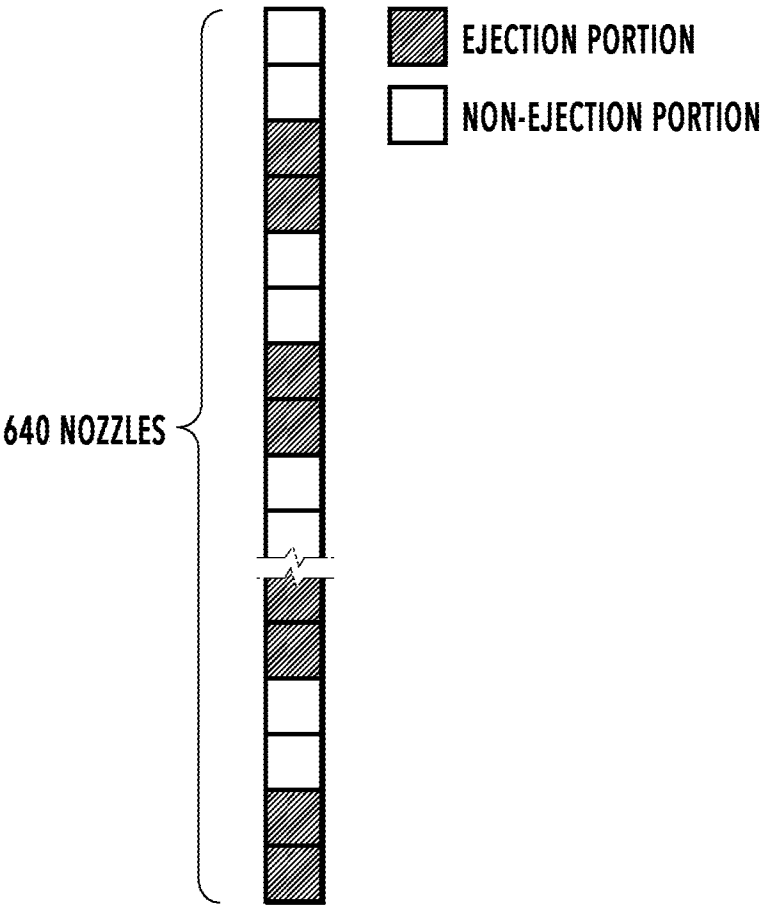
FIG. 8A and FIG. 8B are diagrams showing mask patterns according to the first embodiment.
Figure 8A:
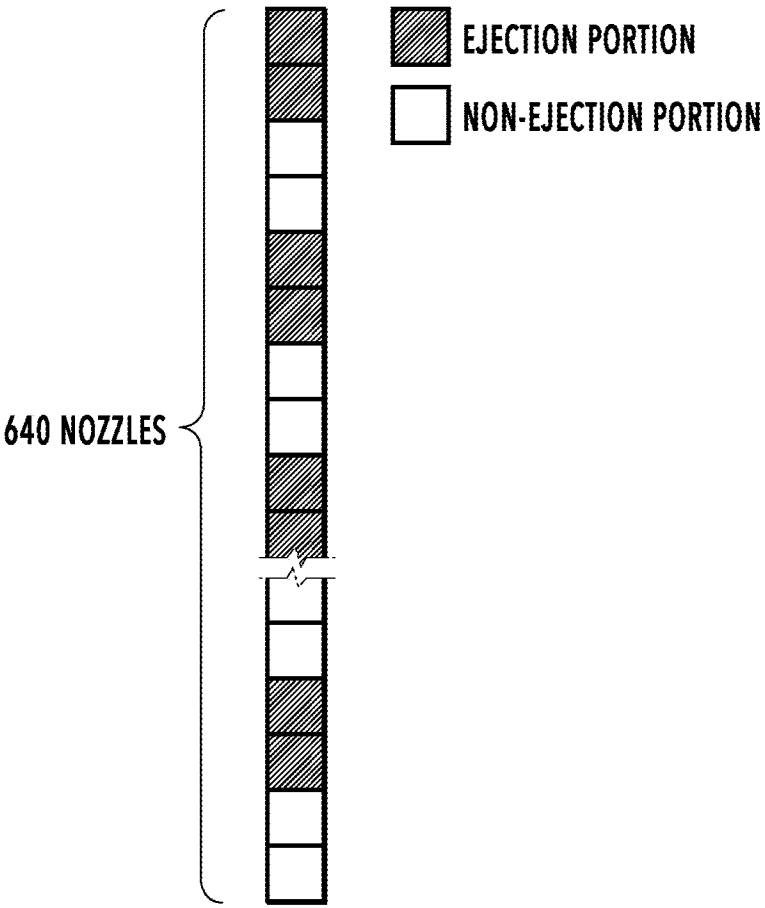

FIG. 8A and FIG. 8B show the masks that are applied in the present embodiment by taking into consideration the above. In FIG. 8A and FIG. 8B, one cell represents one nozzle and the odd-numbered raster represents the Odd column and the even-numbered raster represents the Even column. The mask A shown in FIG. 8A is a repetition of ejection of both Odd column and Even column and non-ejection of both Odd column and Even column. On the other hand, the mask B shown in FIG. 8B is a repetition of non-ejection of both Odd column and Even column and ejection of both Odd column and Even column. By using both the masks such as those, the data of the same nozzle is distributed to one of the first pass and the second pass without exception, and therefore, it is possible to suppress a reduction in density resulting from the deviated landing in the X-direction between passes. Further, the ejection data is distributed equally to the Odd column and the Even column, and therefore, it is possible to suppress the temperature rise of the print head at the time of vacant ejection. The above is the contents of the mask application method according to the present embodiment.

<About Modification Example>

The setting method of the temperature threshold values Tth1 and Tth2, the standby time t1, and the number of dots threshold value Dth is not limited to only that described previously.

Further, in the present embodiment, the method is described in which in a case where the temperature of the print head exceeds the predetermined temperature threshold value, the printing apparatus stands by for a predetermined time, that is, waits for the print head to become cool, but the present embodiment is not limited to the method. For example, in a case where the head temperature exceeds the predetermined temperature threshold value, it may also be possible to stop the printing operation and cancel printing of the remaining print data in place of standing by.

Further, in the present embodiment, between the scans of the print head, the temperature of the print head is detected and whether the detected temperature is less than or equal to the predetermined temperature threshold value is determined (NO at S513→S501→S502), but it may also be possible to detect and determine the temperature of the print head such as this also during the printing operation. Specifically, the temperatures Th1 and Th2 are acquired at all times. Then, it may also be possible to create a design so that in a case where the acquired temperature exceeds the temperature threshold values Tth1 and Tth2, this is regarded as abnormal and the printing operation is stopped immediately, specifically, ink ejection is stopped. Alternatively, it may also be possible to create a design so that in a case where the state where the temperatures Th1 and Tth2 exceed the temperature threshold values Tth1 and Tth2 continues for a predetermined time or more, the printing operation is stopped, specifically, ink ejection is stopped. For example, in a case of the characteristic as shown in FIG. 6B, by setting Tth1=Tth2=80° C. and immediately stopping the printing operation in a case where the detected temperature exceeds the temperature threshold value, it is possible to obtain the same effects as those of the present embodiment. Alternatively, also by setting Tth1=Tth2=70° C. and immediately stopping the printing operation in a case where the state where the detected temperature exceeds the temperature threshold value continues for 0.2 sec or more, it is possible to obtain the same effects as those of the present embodiment.

Further, in the present embodiment, as the method of suppressing the temperature rise of the print head at the time of vacant ejection, the method of dividing one-pass printing into two-pass printing is adopted. However, the method of suppressing the temperature rise of the print head at the time of vacant ejection is not limited to this. For example, in place of dividing one-pass printing into two-pass printing, by reducing the operation speed of the unit (the carriage 108 and the like) configured to relatively move the print head and the printing medium while maintaining one-pass printing, it is possible to obtain the same effects. In a case where the operation speed of the carriage 108 is halved, on the assumption that the time required for one scan without reducing the operation speed is taken as the unit time, the amount of ink that is ejected per unit time in a case where the operation speed is halved is about half compared to that in a case where the operation speed is not reduced. Further, the present embodiment is not limited to the case where one-pass printing is divided into two-pass printing and it is possible to apply the present embodiment to a case where $\alpha$-time printing is divided into $\beta$-time printing (here, $\alpha<\beta$). As described above, it may also be possible to adopt any method of reducing and any unit configured to reduce, the amount of ink that is ejected from the print head per unit time.

Further, in the above, explanation is given by using the multi-pass printing method in which printing is performed by the print heads 109 and 110 scanning on the printing medium a plurality of times, but it may also be possible to use a line-head type print head in which the print head is arranged across the width of the printing medium. In a case of the line-head type print head, printing is performed on the printing medium by ejecting ink from the print head while conveying the printing medium. In a case of the line-head type print head, the number of dots Da for printing one page for a cut sheet or printing one image or a part thereof for roll paper is counted. In a case where the number of dots Da exceeds the number of dots threshold value Dth, by reducing the speed at which the printing medium is conveyed, it is possible to reduce the amount of ink that is ejected during printing per unit time in the time in which one image is printed.

Second Embodiment

In the first embodiment, the case is explained where the area in which the number of dots is counted (specifically, the nozzle area A) is only one. In a case where the number of nozzles of the print head 110 is still larger, on a condition that there is only one area in which the number of dots is counted, there is a possibility that the temperature at the ejection portion at the time of vacant ejection reaches the upper limit temperature Tf or more depending on the print data. For example, in a case where the number of nozzles of the print head 110 is 800, not 640, even though the heat generation amount by a heater is the same, a longer time is required for the heat to be conducted to the Di sensors at both ends, and therefore, Tf is reached by vacant ejection of the number of nozzles smaller than 160 shown in the first embodiment.

Figure 10C:
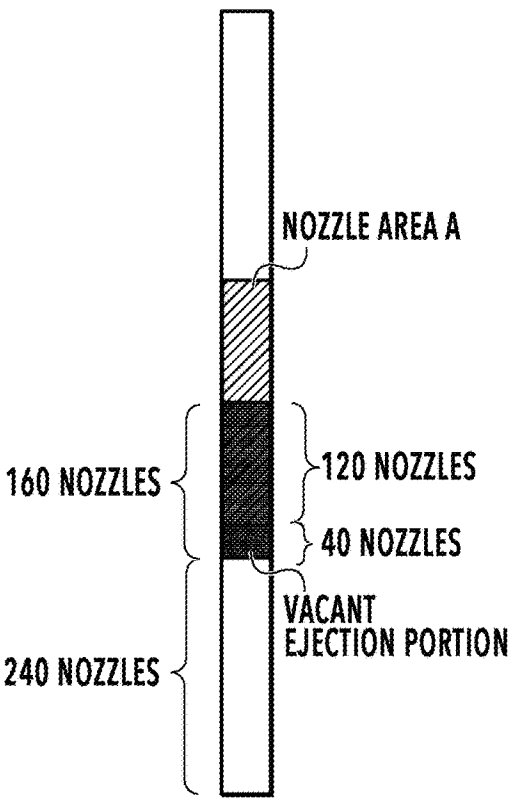
FIG. 10A to FIG. 10C are diagrams for explaining a problem that is solved in a second embodiment.
Figure 10B:
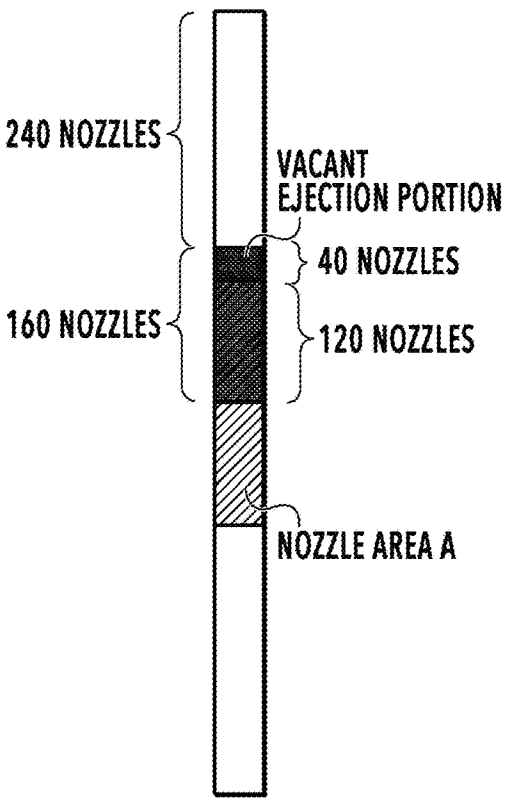
Figure 10A:
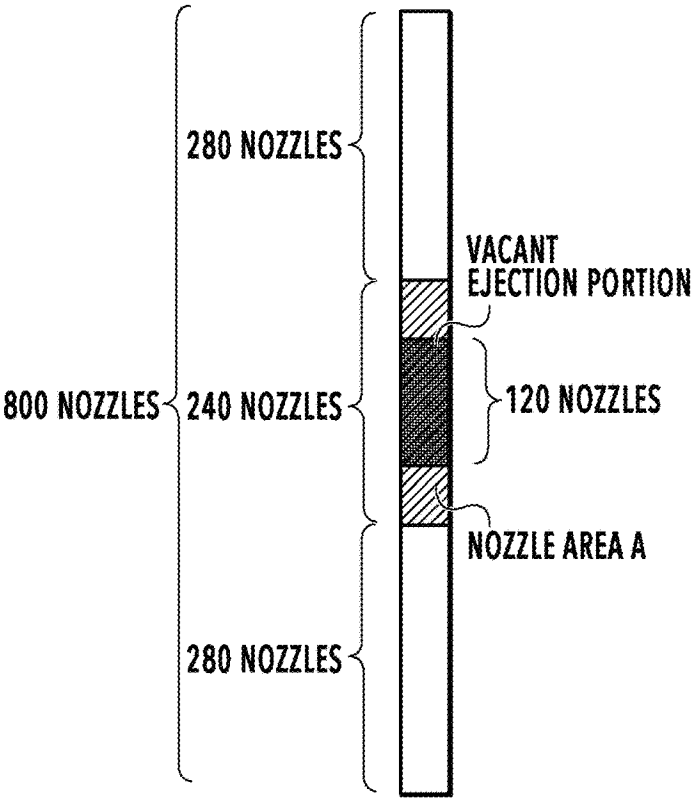

In the present embodiment, as shown in FIG. 10A, an example is shown in which the temperature reaches Tf by vacant ejection with 100% duty in 120 nozzles at the center of the print head substrate. As in the first embodiment, in a case where duty at the vacant ejection portion with which Tf is not reached irrespective of the number of nozzles under the condition that Tth1=Tth2=70° C. is set to 50% or less, as the threshold value Dth, the number of dots, that is, 120 nozzles×8.27 in.×600 dpi 100% duty is set. Further, in addition to this, it is sufficient to set the area of 240 nozzles as the nozzle area A in which the number of dots is counted.

On the other hand, in a case where vacant ejection is performed in 160 nozzles as shown in FIG. 10B or FIG. 10C, the shortest distance from the vacant ejection portion to the Di sensor is a distance corresponding to 240 nozzles, and this is the same as in the first embodiment (see FIG. 6A). Because of this, also in a case of FIG. 10B or FIG. 10C, as in the first embodiment, the temperature at the vacant ejection portion reaches Tf by the scan next to the scan in which the Di sensor detects Tth1=Tth 2=70° C. However, the number of dots Da counted within the nozzle area A is less than or equal to Dth, and therefore, even in a case where the number of nozzles performing vacant ejection outside the nozzle area A increases, Da>Dth does not hold and the printing operation cannot be divided (that is, NO at S506 does not occur). In such a case, there is a possibility that the temperature at the vacant ejection portion reaches Tf or more by the scan next to the scan in which the Di sensor detects Tth1 or Tth2. As described above, in a case where only one area in which the dots are counted is provided, there is a possibility that the temperature at the vacant ejection portion reaches Tf or more on a condition that vacant ejection is performed in a comparatively large number of nozzles including the nozzles outside the area (specifically, on the side nearer to the Di sensor than the center of the print head substrate). In the present embodiment, the configuration with which it is possible to solve this problem is described. Explanation of the same contents as those of the first embodiment described previously is omitted appropriately.

<About Printing Processing>

Figure 11:
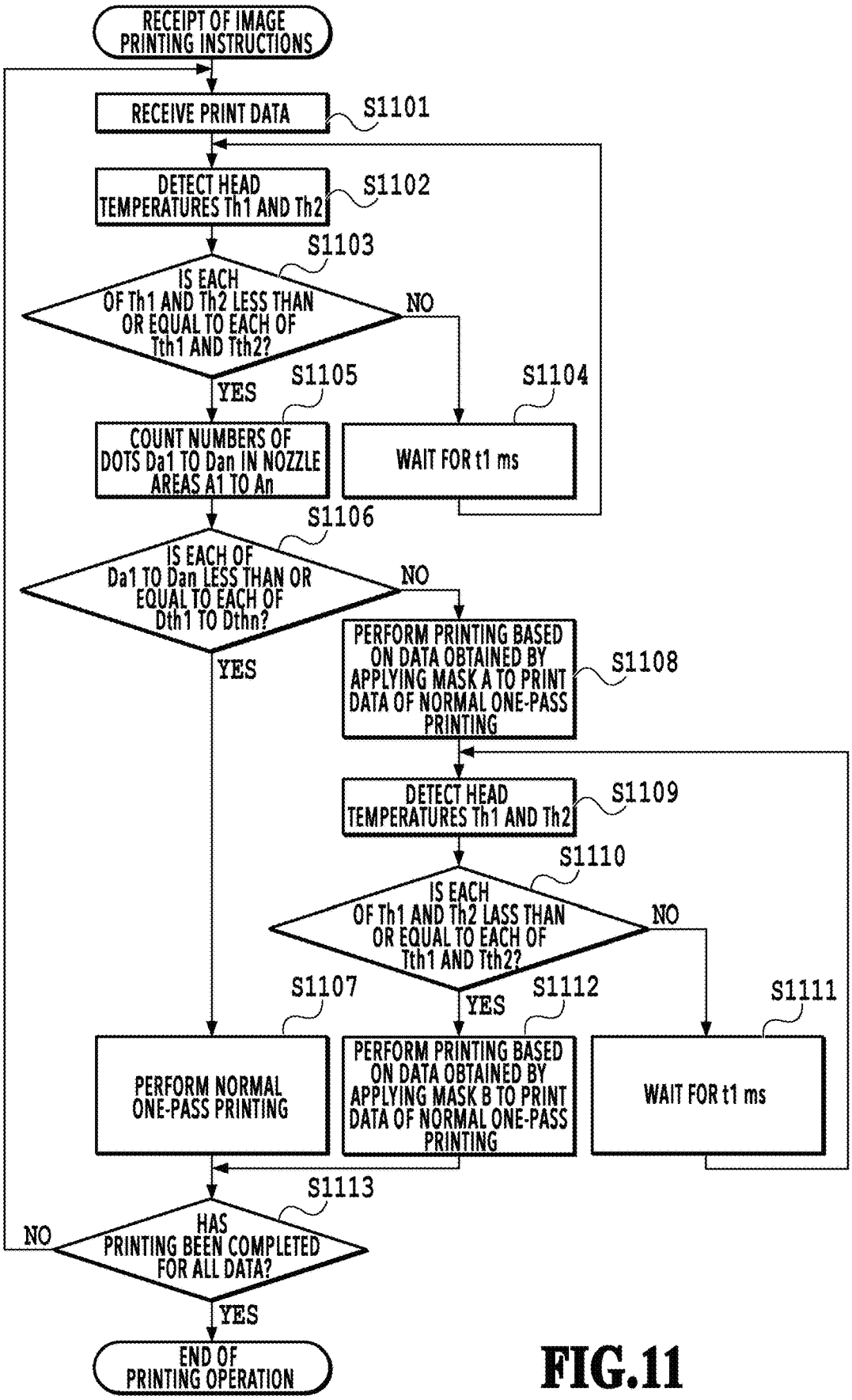
FIG. 11 is a flowchart of printing processing according to the second embodiment.

In the following, processing to perform the printing operation in the print head 110 according to the present embodiment is explained by using FIG. 11. FIG. 11 is a flowchart of the printing processing according to the present embodiment. S1101 to S1104 and S1107 to S1113 are the same as S501 to S504 and S507 to S513 in the first embodiment, and therefore, explanation is omitted (see FIG. 5).

At S1105, as in the case with S505, the number of dots in a predetermined nozzle area is counted. However, in the present embodiment, as areas in which the number of dots is counted, a plurality of nozzle areas (referred to as A1 to An) is provided and numbers of dots (referred to as Da1 to Dan) in respective areas are counted.

Then, at S1106, the MPU 302 determines the magnitude relationship between the numbers of dots Da1 to Dan counted at S505 and predetermined number of dots threshold values (referred to as Dth1 to Dthn). Specifically, whether the number of dots Da1 is less than or equal to the number of dots threshold value Dth1 is determined and similarly, whether each of the other numbers of dots Da2 to Dan is less that or equal to the corresponding number of dots threshold value is determined. As a result of that, in a case where all the determination results are affirmative, the processing advances to S1107. On the other hand, in a case where even one of these determination results is negative, the processing advances to S1108 in order to perform printing by dividing the next scan into two passes.

<About Setting Method of Nozzle Area and Number of Dots Threshold Value>

In the following, the setting method of the nozzle area and the number of dots threshold value used at S1105 and S1106 described previously is explained by using FIG. 12A to FIG. 12C and FIG. 13A and FIG. 13B. It is possible to set nozzle areas A1 to An used at S1105 and the number of dots threshold values Dth1 to Dthn used at S1106 based on the temperature rise characteristic at the time of vacant ejection of the print head 110, the temperature threshold values Tth1 and Tth2, and the upper limit temperature Tf as in the first embodiment.

Figures 12A, 12B, 12C:
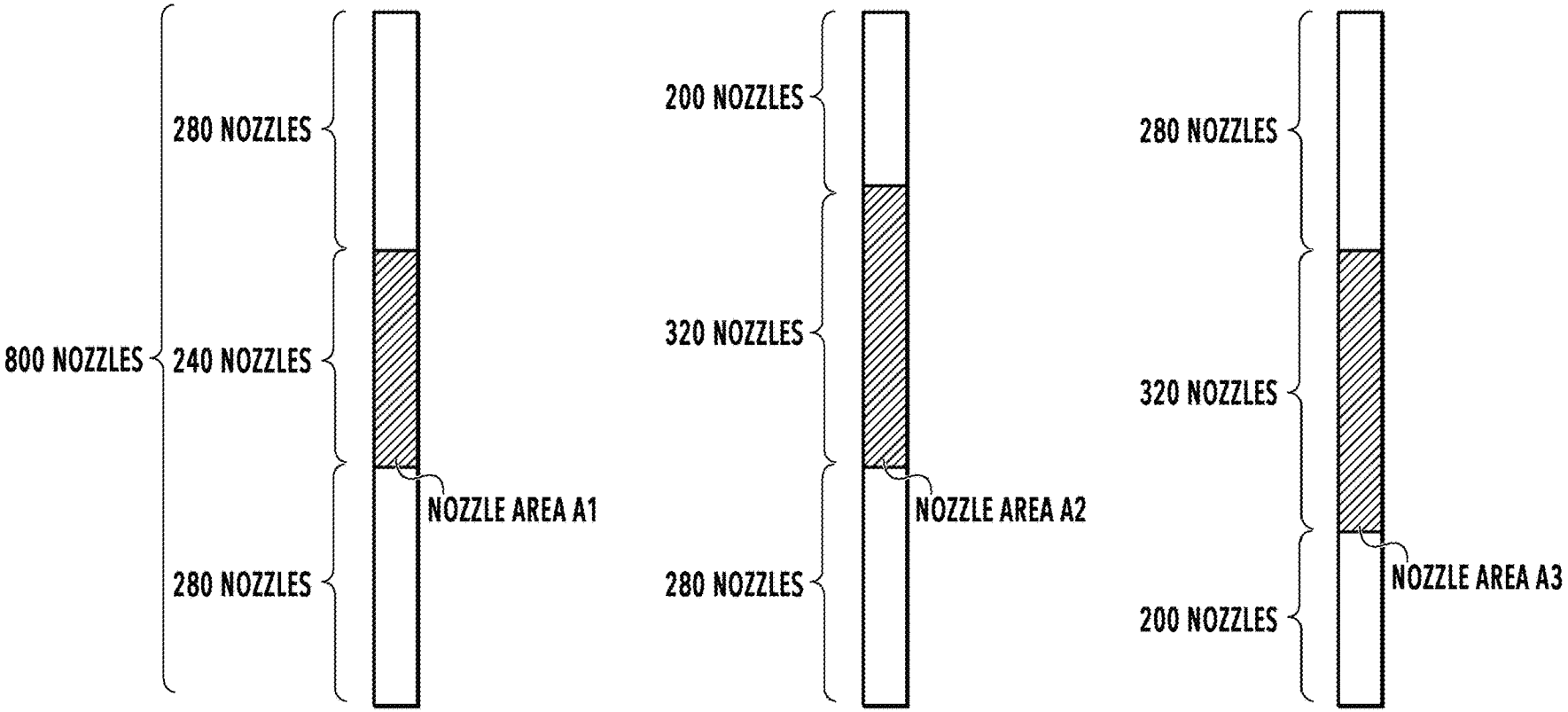
FIG. 12A to FIG. 12C are diagrams showing nozzle areas A1 to A3 according to the second embodiment.

In a case of the print data shown in FIG. 10A, as described previously, it is sufficient to set the area including 240 nozzles at the center of the print head substrate as the area in which the number of dots is counted and as shown in FIG. 12A, this area is taken as the nozzle area A1. Further, as the number of dots threshold value, it is sufficient to set 120 nozzles×100% duty×8.27 in.×600 dpi=595,440 and this value is taken as the number of dots threshold value Dth1.

In a case of the print data shown in FIG. 10B, as the number of dots threshold value, it is sufficient to set 160 nozzles×100% duty×8.27 in.×600 dpi=793,920 and this value is taken as the number of dots threshold value Dth2. On the other hand, the area in which the number of dots is counted is set by utilizing that Tf is not reached irrespective of the number of nozzles in a case where duty at the vacant ejection portion is 50% or less. Specifically, it is sufficient to set the area including 320 nozzles (=Dth2/(A4 width 8.27 in.×printing resolution 600 dpi×50% duty)) as shown in FIG. 12B and this area is taken as the nozzle area A2.

Similarly, for the print data shown in FIG. 10C it is sufficient to set the number of dots threshold value Dth3=793,920 dots and as the nozzle area A3, set the area including 320 nozzles as shown in FIG. 12C.

By designing the configuration as described above, even though not detected in the nozzle area A1, in each of the nozzle area A2 and the nozzle area A3, it is possible to suppress the number of nozzle that performs vacant ejection with 100% duty to 160 or less, and therefore, it is made possible to suppress the temperature at the time of vacant ejection to Tf or less. As explained above, by each of the nozzle area A2 and the nozzle area A3 including at least a part of the nozzle area A1, it is possible to set the nozzle areas A2 and A3 and the threshold values Dth2 and Dth3 corresponding thereto by taking the nozzle area A1 and the threshold value Dth1 thereof as the precondition. Due to this, it is possible to set the nozzle areas A2 and A3 to a size including the number of nozzles in A1 or more and set the threshold values Dth 2 and Dth3 to a value larger than or equal to the threshold value corresponding to the nozzle area A1 (that is, larger than or equal to Dth1). This is the important feature of the present embodiment.

Figure 13B:
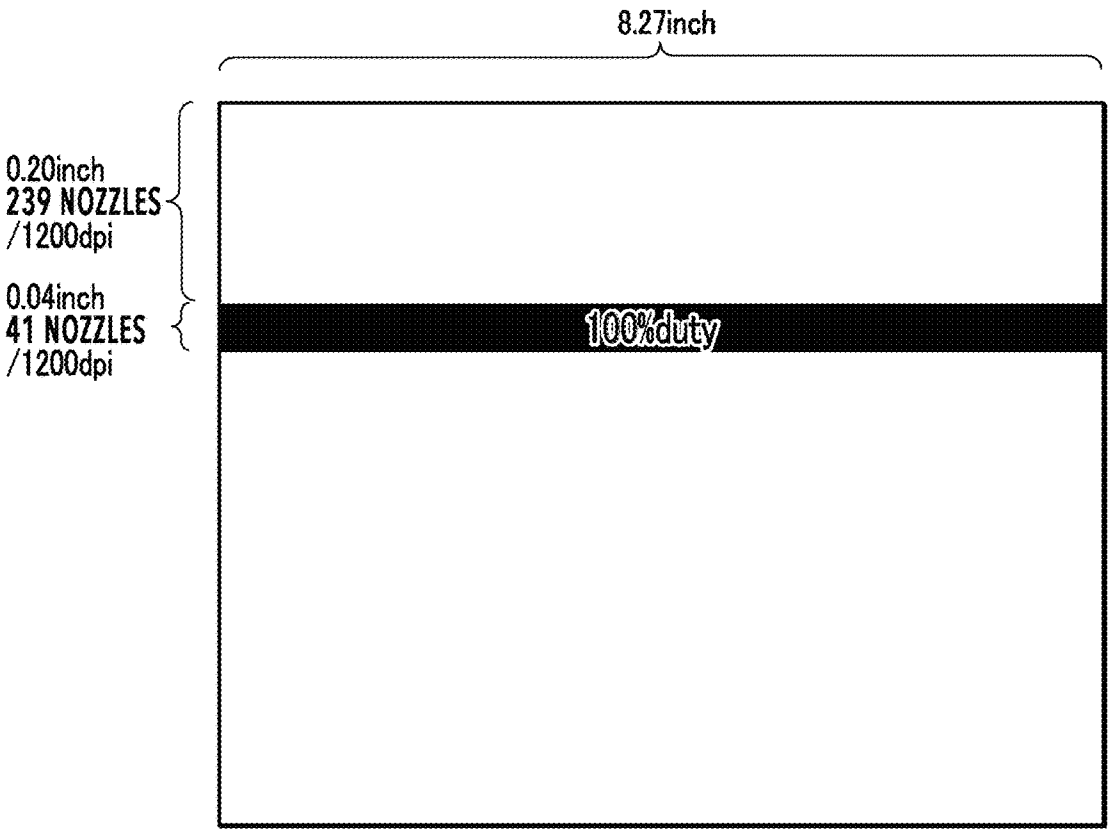
FIG. 13A and FIG. 13B are diagrams showing a prior art.
Figure 13A:
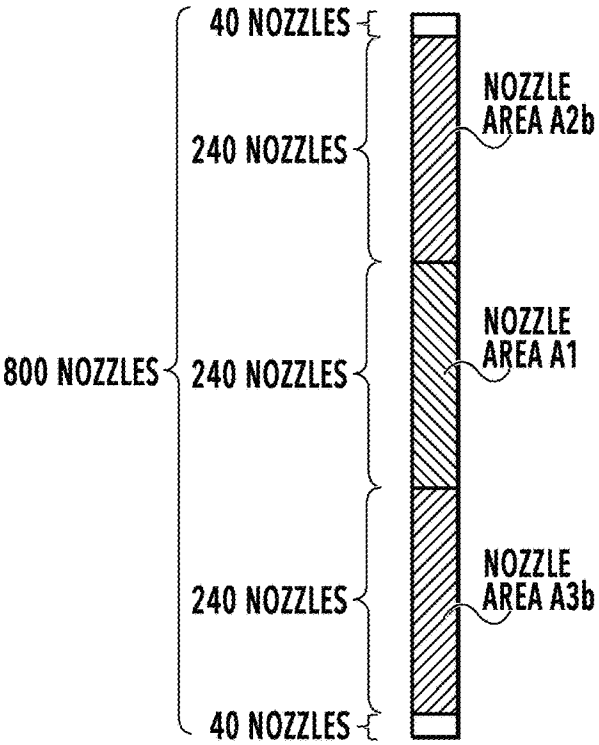

In order to verify this feature, a case is considered where the nozzle area A2 in FIG. 12B is set without taking the nozzle area A1 and the threshold value Dth1 thereof as the precondition. On a condition that the threshold value for the nozzle area A2 in this case is taken as Dth2*b*, the constraint condition is the print data shown in FIG. 10A and as a result of this, it is necessary to set 595,440 dots as Dth2*b*. Consequently, compared to a case where control is performed by combining the nozzle A1 and Dth1 and the nozzle are A2 and Dth2, print data that reduces throughput unnecessarily occurs. Further, as shown in FIG. 13A, in a case where nozzle areas A2*b* and A3*b* are set without including the nozzle area A1, the number of vacant ejection nozzles with 100% duty permitted within A2*b* and A3*b* is 40 as shown in FIG. 10B and FIG. 10C. In this case also, the print data for which it is not necessary to divide printing originally is the target of division, and therefore, throughput is reduced unnecessarily. The above is the contents of the setting method of the nozzle area and the number of dots threshold value according to the present embodiment.

<About Effects and Modification Example of the Present Embodiment>

As above, in the present embodiment, the n (n is an integer not less than two) nozzle areas A1 to An as the areas in which dots are counted and the number of dots threshold values Dth1 to Dthn corresponding thereto are provided. Further, each of the nozzle areas A2 to An is caused to include at least a part of any of the nozzle areas A1 to An−1. Due to this, even in a case where the print head substrate is long, it is possible to prevent trouble due to the abnormal temperature rise of the head at the time of vacant ejection while suppressing throughput from being reduced unnecessarily. In the present embodiment, the case is shown where the number of nozzle areas is three, but the number of nozzle areas is not limited to three. It may also be possible to set the number of nozzle areas to two or an arbitrary value larger than or equal to four in accordance with the characteristic of the print head.

Other Embodiments

It may also be possible appropriately combine the configuration of each of the first to sixth embodiments described previously.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

According to one embodiment of the present invention, it is made possible to prevent the occurrence of trouble due to the abnormal temperature rise of the print head at the time of the ejection operation even in a case where there is no ink within the print head while suppressing a reduction in throughput irrespective of the ink remaining amount of the ink tank.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-072664, filed Apr. 5, 2019, which is hereby incorporated by reference herein in its entirety.

What is claimed is:

1. A printing apparatus comprising:

a print head having a printing element column in which a plurality of printing elements for ejecting ink from ejection ports is arrayed, the print head performing printing on a printing medium by ejecting ink based on print data;

a sensor that detects temperature of the print head;

an acquisition unit configured to acquire information indicating a number of dots to be printed by printing elements corresponding to a predetermined area in the printing element column, the predetermined area being apart from one or more printing elements that include a printing element closest to the sensor in an array direction of the plurality of printing elements; and a control unit configured to control a printing operation of the print head based on (a) the temperature detected by the sensor and (b) the number of dots acquired by the acquisition unit, and not based on a number of dots to be printed by the one or more printing elements, wherein the printing apparatus performs printing on the printing medium by ejecting ink from the print head while the print head and the printing medium are moving relatively, wherein the control unit controls, in a case where the number of dots indicated by the information, which corresponds to the predetermined area, is smaller than or equal to a threshold value, the printing operation of the print head so as to perform the printing operation in a first mode, and wherein the control unit controls, in a case where the number of dots indicated by the information, which corresponds to the predetermined area, is larger than the threshold value, the printing operation of the print head so as to perform the printing operation in a second mode in which a number of dots to be printed per unit time by ejecting ink from the print head is smaller than that in the first mode.

2. The printing apparatus according to claim 1, wherein the print head performs printing on the printing medium by scanning in a direction intersecting with a direction in which the printing element column is arrayed, and wherein the acquisition unit acquires the number of dots driven by the printing elements in the predetermined area by a one-time scan of the print head.

3. The printing apparatus according to claim 2, wherein the control unit controls, in a case where the number of dots acquired by the acquisition unit is less than or equal to the threshold value, the printing operation of the print head in the first mode in which a scan is performed a predetermined number of times for an area including the same area on the printing medium, and controls, in a case where the number of dots acquired by the acquisition unit is larger than the threshold value, the printing operation of the print head in the second mode in which a scan is performed a number of times larger than the predetermined number of times for an area including the same area on the printing medium.

4. The printing apparatus according to claim 3, wherein the predetermined number of times is one.

5. The printing apparatus according to claim 2, wherein the control unit controls, in a case where the acquired number of dots is larger than the threshold value, the printing operation of the print head in the second mode in which a scanning speed of the print head is slower than that in the first mode in a case where the number of dots is less than or equal to the threshold value.

6. The printing apparatus according to claim 1, further comprising:

a conveyance unit configured to convey the printing medium, wherein the printing elements of the print head are arrayed across the width of the printing medium, wherein the printing apparatus performs printing by ejecting ink from the print head while the conveyance unit is conveying the printing medium, and wherein the control unit controls, in a case where the number of dots indicated by the information acquired by the acquisition unit is larger than or equal to the threshold value, the printing operation of the print head in the first mode in which the conveyance unit conveys the printing medium at a predetermined speed and the print head ejects ink, and controls, in a case where the number of dots indicated by the information acquired by the acquisition unit is larger than the threshold value, the printing operation of the print mode in the second mode in which the conveyance unit conveys the printing medium at a speed slower than the predetermined speed and the amount of ink ejected by the print head per unit time is smaller that in the first mode.

7. The printing apparatus according to claim 1, wherein the predetermined area includes a first area and a second area, wherein the threshold value includes a first threshold value corresponding to the first area and a second threshold value corresponding to the second area, and wherein the second area includes at least one or more of the printing elements included in the first area and at least one or more of the printing elements not included in the first area.

8. The printing apparatus according to claim 7, wherein a number of printing elements included in the second area is larger than or equal to a number of printing elements included in the first area, and wherein the second threshold value is larger than or equal to the first threshold value.

9. The printing apparatus according to claim 7, wherein the predetermined area is n, n being an integer not less than two, areas including the first area and the second area, and wherein the threshold value is a threshold value corresponding to each of the n areas, which includes the first threshold value and the second threshold value.

10. The printing apparatus according to claim 9, further comprising:

a determination unit configured to determine whether the number of dots acquired by the acquisition unit is less than or equal to the threshold value for each of the n areas.

11. The printing apparatus according to claim 10, wherein the control unit:

controls, in a case where all determination results by the determination unit for each of the n areas are affirmative, the print head so as to perform printing by a one-time scan based on the print head and on the other hand; and controls, in a case where even one of the determination results by the determination unit for each of the n areas is negative, the print head so as to perform printing by a plurality of scans based on data obtained by dividing the print data.

12. The printing apparatus according to claim 1, wherein the sensor detects the temperature of the print head between scans of the print head.

13. The printing apparatus according to claim 12, wherein the control unit stops, in a case where the temperature acquired by the sensor exceeds a predetermined temperature threshold value, printing by the print head until a temperature less than or equal to the predetermined temperature threshold value is acquired by the sensor.

14. The printing apparatus according to claim 1, wherein while printing by the print head is being performed, the temperature of the print head is acquired at all times by the sensor.

15. The printing apparatus according to claim 14, wherein the control unit stops, in a case where the temperature acquired by the sensor exceeds a predetermined temperature threshold value, ink ejection from the printing element.

16. The printing apparatus according to claim 15, wherein the control unit stops, in a case where a state where the temperature acquired by the sensor exceeds a predetermined temperature threshold value continues for a predetermined time or more, ink ejection from the printing element.

17. The printing apparatus according to claim 1, wherein the one or more printing elements comprises plural printing elements including a printing element adjacent to the printing element closest to the sensor.

18. The printing apparatus according to claim 17, wherein a number of the one or more printing elements is one-fourth or more of the total number of the plurality of printing elements in the printing element column.

19. The printing apparatus according to claim 17, wherein the one or more printing elements include printing elements within a range of 0.13 inches in the array direction from the printing element closest to the sensor.

20. The printing apparatus according to claim 1, wherein the acquisition unit acquires information indicating a number of dots to be printed by printing elements other than the one or more printing elements.

21. A printing apparatus comprising:

a print head having a printing element column in which a plurality of printing elements ejecting ink is arrayed, the print head moving along a direction intersecting with a direction in which the plurality of printing elements is arrayed;

a sensor that detects temperature of the print head;

an acquisition unit configured to acquire a number of dots to be printed by printing elements corresponding to a predetermined area in the printing element column, the predetermined area being apart from one or more printing elements that include a printing element closest to the sensor in an array direction of the plurality of printing elements; and a control unit configured to control a printing operation of the print head based on (a) the temperature detected by the sensor and (b) the number of dots acquired by the acquisition unit, and not based on a number of dots to be printed by the one or more printing elements, wherein the control unit controls, in a case where the number of dots corresponding to the predetermined area is smaller than or equal to a threshold value, the printing operation of the print head so as to perform printing by a one-time scan based on print data, and wherein the control unit controls, in a case where the number of dots corresponding to the predetermined area is larger than the threshold value, the printing operation of the print head so as to perform printing by a plurality of scans based on data obtained by dividing print data corresponding to the one-time scan.

22. A printing method in a printing apparatus, the printing apparatus comprising (1) a print head having a printing element column in which a plurality of printing elements for ejecting ink from ejection ports is arrayed, the print head performing printing on a printing medium by ejecting ink based on print data; (2) a sensor that detects temperature of the print head; (3) an acquisition unit configured to acquire information indicating a number of dots to be printed by printing elements corresponding to a predetermined area in the printing element column, the predetermined area being apart from one or more printing elements that include a printing element closest to the sensor in an array direction of the plurality of printing elements; and (4) a control unit configured to control a printing operation of the print head based on (a) the temperature detected by the sensor and (b) the number of dots acquired by the acquisition unit, and not based on a number of dots to be printed by the one or more printing elements, wherein the printing apparatus performs printing on the printing medium by ejecting ink from the print head while the print head and the printing medium are moving relatively, the printing method comprising:

a step of controlling, by the control unit, in a case where the number of dots indicated by the information, which corresponds to the predetermined area, is smaller than or equal to a threshold value, the printing operation of the print head so as to perform the printing operation in a first mode, and controlling, in a case where the number of dots indicated by the information, which corresponds to the predetermined area, is larger than the threshold value, the printing operation of the print head so as to perform the printing operation in a second mode in which a number of dots to be printed per unit time by ejecting ink from the print head is smaller than that in the first mode.

23. A non-transitory computer-readable storage medium storing a program for causing a computer to perform a printing method in a printing apparatus comprising (1) a print head having a printing element column in which a plurality of printing elements for ejecting ink from ejection ports is arrayed, the print head performing printing on a printing medium by ejecting ink based on print data; (2) a sensor that detects temperature of the print head; (3) an acquisition unit configured to acquire information indicating a number of dots to be printed by printing elements corresponding to a predetermined area in the printing element column, the predetermined area being apart from one or more printing elements that include a printing element closest to the sensor in an array direction of the plurality of printing elements; and (4) a control unit configured to control a printing operation of the print head based on (a) the temperature detected by the sensor and (b) the number of dots acquired by the acquisition unit, and not based on a number of dots to be printed by the one or more printing elements, wherein the printing apparatus performs printing on the printing medium by ejecting ink from the print head while the print head and the printing medium are moving relatively, the printing method comprising:

a step of controlling, by the control unit, in a case where the number of dots indicated by the information, which corresponds to the predetermined area, is smaller than or equal to a threshold value, the printing operation of the print head so as to perform the printing operation in a first mode, and controlling, in a case where the number of dots indicated by the information, which corresponds to the predetermined area, is larger than the threshold value, the printing operation of the print head so as to perform the printing operation in a second mode in which a number of dots to be printed per unit time by ejecting ink from the print head is smaller than that in the first mode.

* * * * *